US011427951B2

(12) United States Patent
Gim

(10) Patent No.: US 11,427,951 B2
(45) Date of Patent: Aug. 30, 2022

(54) WALL MOUNTED WASHING MACHINE

(71) Applicant: DONGBU DAEWOO ELECTRONICS CORPORATION, Seoul (KR)

(72) Inventor: Jeong Hyeon Gim, Incheon (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 1017 days.

(21) Appl. No.: 15/934,800

(22) Filed: Mar. 23, 2018

(65) Prior Publication Data

US 2018/0363188 A1 Dec. 20, 2018

(30) Foreign Application Priority Data

Jun. 14, 2017 (KR) ..... 10-2017-0074639

(51) Int. Cl.
*D06F 39/14* (2006.01)
*D06F 17/06* (2006.01)
*D06F 39/08* (2006.01)

(52) U.S. Cl.
CPC ..... *D06F 39/14* (2013.01); *D06F 17/06* (2013.01); *D06F 39/083* (2013.01)

(58) Field of Classification Search
CPC ..... D06F 17/06; D06F 39/14; D06F 33/00; D06F 37/10; D06F 39/083; D06F 39/12; D06F 2224/00
USPC ..... 68/139, 196, 140, 212, 3 R, 12.26; 312/326
See application file for complete search history.

(56) References Cited

U.S. PATENT DOCUMENTS 3,042,471 A * 7/1962 Haslup ..... D06F 58/04 439/31
5,421,175 A * 6/1995 Niu ..... D06F 23/02 68/24
8,382,216 B2 * 2/2013 Favaro ..... D06F 39/14 16/389
10,487,434 B2 11/2019 Hwang et al.
2004/0083769 A1 * 5/2004 Kim ..... D06F 37/28 134/58 DL
2006/0012190 A1 * 1/2006 Alacqua ..... D06F 37/28 292/341.16

(Continued)

FOREIGN PATENT DOCUMENTS

CN 101476232 A 7/2009
CN 103975104 A 8/2014

(Continued)

*Primary Examiner* — David G Cormier
*Assistant Examiner* — Thomas Bucci

(57) ABSTRACT

A wall mounted washing machine includes a cabinet having a front surface and a rear surface to be opened to form an appearance; a tub disposed in the cabinet to store wash water; a front panel installed in the tub; a drum rotatably installed in the tub: a cover installed in the front panel and having a door hinge; a door rotatably coupled to the door hinge and having a door glass; and a door opening and closing device having an electronic opening and closing type adapted for locking or unlocking the door to/from the door. The door hinge adapted for rotatably supporting the door based on the cover to open and close the laundry inlet of the cover and includes a cable guide tunnel which forms a path through which a cable extending from the inside of the door into the cabinet.

5 Claims, 13 Drawing Sheets

(56) References Cited

U.S. PATENT DOCUMENTS

2006/0059710 A1* 3/2006 Kim ..... D06F 39/14 34/201
2006/0101873 A1* 5/2006 Kim ..... D06F 37/28 68/196
2006/0255700 A1* 11/2006 Park ..... D06F 39/12 68/3 R
2009/0064534 A1* 3/2009 LeClerc ..... D06F 58/20 34/603
2012/0233873 A1* 9/2012 Del Pos ..... D06F 39/125 34/108
2012/0242205 A1* 9/2012 Del Pos ..... D06F 39/125 312/228
2014/0076007 A1* 3/2014 Hwang ..... D06F 39/12 52/741.1
2014/0298866 A1* 10/2014 Hwang ..... D06F 37/06 68/139
2015/0169194 A1* 6/2015 Ban ..... G06F 3/04842 715/771
2015/0211167 A1* 7/2015 Kim ..... D06F 37/08 68/3 R
2016/0194802 A1* 7/2016 Heo ..... D06F 39/12 174/541
2016/0201251 A1* 7/2016 Zhang ..... D06F 39/14 700/275
2017/0121886 A1* 5/2017 Kwon ..... D06F 39/14
2017/0121897 A1* 5/2017 Kwon ..... D06F 39/14
2018/0002853 A1* 1/2018 Anand ..... D06F 39/14
2018/0002854 A1* 1/2018 Anand ..... D06F 34/34
2018/0038040 A1* 2/2018 Kim ..... D06F 37/06
2018/0135219 A1* 5/2018 Frantz ..... D06F 39/14
2018/0142399 A1* 5/2018 Chun ..... D06F 34/10
2018/0216381 A1* 8/2018 Lee ..... D06F 39/14
2020/0354875 A1 11/2020 Chun et al.

FOREIGN PATENT DOCUMENTS

WO 2017018710 A1 2/2017
WO WO-2017018710 A1 * 2/2017 ..... D06F 34/08

* cited by examiner

WALL MOUNTED WASHING MACHINE

CROSS REFERENCE TO RELATED PATENT APPLICATION

The present disclosure claims benefit to Korean Patent Application No. 10-2017-0074639, filed on, Jun. 14, 2017, by inventor Jeong Hyeon GIM, which application is hereby incorporated by reference for all purposes.

TECHNICAL FIELD

The disclosure relates to relates to a wall mounted washing machine.

BACKGROUND

A washing machine is a device for separating contaminants from washed fabric (laundry) using wash water and detergent, wherein the contaminants may be separated from the washed fabric by the chemical action of the detergent dissolved in the wash water and the mechanical action of the wash water and an inner basket. Such washing machines may be categorized into a top loading type washing machine, a front loading type washing machine, and a combined type washing machine combined with the top loading type and the front loading type, depending on the method of loading the laundry.

In recent years, wall mounted washing machines have been introduced, which may be installed in narrow spaces such as bathrooms and toilets. In general, the wall mounted washing machines employ the front loading type for better miniaturization.

For example, the wall mounted washing machine may include a cabinet that forms an exterior, a tub provided in the cabinet filled with wash water, a drum rotatably installed in the tub and accommodating the laundry, a drive unit providing power to the drum, a water supply unit for supplying the wash water to the tub, and a drain unit for discharging the wash water from the tub to the outside of the cabinet A conventional wall mounted washing machine has a separate knob or handle for opening and closing the door with added force, which makes opening and closing the door fairly inconvenient. In addition, due to the repetitive load pulling on the door, there is a risk of damage to the knob or handle.

In addition, in the conventional wall mounted washing machine, a cable is extended from the door to the tub side in order to electrically connect a PCB circuit provided in the door and a control unit provided between the tub and the case. In this case, there is a drawback related to a potential unstable electrical connection due in part to cable twisting and also environmental exposure of the cable when connecting the cable from the door to the tub.

SUMMARY

In view of the foregoing, embodiments of the present disclosure are drawn to a wall mounted washing machine provided with a door opening and closing device having an electronic opening and closing type device which facilitates opening the door and also releases and opens the door by simply pressing a door opening button.

Further, embodiments of the disclosure provide a wall mounted washing machine in which prevents twisting the cable that electrically connects the PCB substrates (provided in the door) and a control unit located in a cabinet enclosure of the machine.

In addition, embodiments of the disclosure provide a wall mounted washing machine in which a cable may be protected from being exposed to the outside of the washing machine when the cable extends from the inside of the door into the cabinet.

More specifically, embodiments of the present invention are drawn to a wall mounted washing machine comprising: a cabinet having front and rear surfaces wherein the rear surface is configured to be open; a tub disposed in the cabinet to store wash water; a front panel disposed in the tub; a drum rotatably installed in the tub: a cover disposed in the front panel and comprising a door hinge; a door rotatably coupled to the door hinge and comprising a door glass; and a door opening and closing device of an electronic opening and closing type and adapted for selectively locking or unlocking the door, wherein the door hinge is adapted for rotatably supporting the door based on the cover to selectively open and close the laundry inlet of the cover, and comprising a cable guide tunnel which forms a path in which a cable is operable to extend from an inside of the door into the cabinet. Embodiments include the above and wherein the door hinge comprises: a door hinge case constituting an upper portion of the door hinge; and a door hinge cap constituting a lower portion of the door hinge, and wherein further the door hinge comprises: a bracket attached to the cover; a first hinge arm and a second hinge arm extending from the bracket to a door side with a curved surface; and a first shaft and a second shaft formed at respective ends of the first hinge arm and the second hinge arm and rotatably coupled to the door and operable to serve as rotation centers of the door, and wherein further the second shaft comprises a second shaft upper portion and a second shaft lower portion.

Embodiments include the above and wherein the second hinge arm comprises a second hinge arm upper portion formed on the door hinge case and a second hinge arm lower portion formed on the door hinge cap, and wherein the second shaft lower portion comprises a first frame in the form of a semicircular tube formed in the door hinge case and a second frame in the form of the semicircular tube formed in the door hinge cap. Embodiments include the above and wherein the cable guide tunnel exists in the second hinge arm and the second shaft lower portion based on a portion where the door hinge case and the door hinge cap are coupled, and wherein further, the cable guide tunnel comprises: a vertical cable guide tunnel formed on the inner side of the first frame and the second frame of the second shaft lower portion; and a horizontal cable guide tunnel formed by shielding an opening by the second hinge arm lower portion, the opening being interconnected in a space with respect to the vertical cable guide tunnel and formed on a bottom surface of the second hinge arm upper portion. Embodiments include the above and wherein the horizontal cable guide tunnel extends to correspond to an extension of the second hinge arm upper portion and to correspond to the shape of a curved surface, and wherein an entrance of the horizontal cable guide tunnel is coupled to a cable guide hole formed in the bracket.

Embodiments include the above and wherein the door opening and closing device comprises: a door hanging unit disposed on the door and protruding toward the cover; a door locking unit disposed on the cover and coupled to the door hanging unit to lock the door hanging unit; and a door opening unit disposed on the door with respect to a position spaced apart from the door hanging unit and adapted to generate a force required to open the door, and wherein the door locking unit is coupled to a control unit located within the cabinet and wherein further the door locking unit releases the door hanging unit in response to a control event from the control unit. Embodiments include the above further comprising a door hinge connection unit and wherein the door comprises: a door inner frame disposed toward the cover and having a plurality of bolt holes and stem through holes; and a door outer frame coupled to the door inner frame through bolts corresponding to the bolt holes, and wherein the door hinge connection unit is provided on one side of the door inner frame and the door outer frame and is adapted for rotatably coupling the door hinge. Embodiments include the above and wherein the door comprises a door opening button. Embodiments include the above and wherein the door opening button comprises a button extension portion protruding from an inner center of the door opening button toward an inner side of the door inner frame.

Embodiments include the above and further comprising an opening button circuit module disposed on the inner side of the door inner frame and operable to be in contact with an end of the button extension portion. Embodiments include the above and wherein the opening button circuit module comprises: a contact switch coupled to the button extension portion; a switch circuit for issuing a locking release signal to the control unit depending on an ON/OFF operation of the contact switch; and the cable, wherein the cable electrically couples the switch circuit and the control unit, the cable being located in the cable guide tunnel. Embodiments include the above and further comprising: a control unit, and wherein the cable electrically couples the opening button circuit module and the control unit, and wherein further the cable extends through an inner space of the cable guide tunnel to be extended from an inside of the door into the cabinet.

Embodiments of the present invention are also drawn to a washing machine comprising: a cabinet having a front surface and a rear surface; a tub disposed in the cabinet to store wash water; a rear panel coupled to the cabinet and operable to be mounted on a vertical surface; a control unit disposed in a front surface of the rear panel with respect to an inner side of the cabinet; a front panel disposed in the tub; a cover disposed on the front panel and comprising: a door hinge on one side; and a door locking unit on the other side; a door rotatably coupled to the door hinge; and a door opening unit disposed on the door to rotate with the door and operable to be compressed upon contacting the cover and operable to store an elastic force therein, and wherein the door hinge comprises a cable guide tunnel adapted for guiding a cable therethrough, the cable for electrically connecting a circuit of the door to the control unit from the door to the inner side of the cabinet. Embodiments include the above and wherein the door comprises: an inner frame comprising a door hanging unit coupled to the door locking unit and a stem through-hole located spaced apart from the door hanging unit; and an outer frame coupled with the inner frame and serving as a support base for the door opening unit, and wherein a door hinge connection unit is disposed on one side of the inner frame and the outer frame and is adapted for rotatably coupling the door hinge.

Embodiments include the above and wherein the door hinge comprises: a door hinge case constituting an upper portion of the door hinge; and a door hinge cap constituting a lower portion of the door hinge, wherein further the door hinge comprises: a bracket attached to the cover; a first hinge arm and a second hinge arm spaced apart from each other and extending from the bracket to a door side with a curved surface; and a first shaft and a second shaft formed at ends of the first hinge arm and the second hinge arm, respectively, and rotatably coupled to the door and operable to serve as rotation centers of the door, and wherein further the second shaft comprises: second shaft upper portion; and a second shaft lower portion. Embodiments include the above and wherein the second hinge arm comprises: a second hinge arm upper portion; and a second hinge arm lower portion, and wherein the second shaft lower portion comprises a first frame and a second frame, and each of the first frame and the second frame has a semicircular groove operable to mutually form a shape. Embodiments include the above and wherein the cable guide tunnel is formed on the second hinge arm and the second shaft lower portion with respect to a portion where the door hinge case and the door hinge cap are coupled, and wherein the cable guide tunnel comprises: a vertical guide tunnel having a shape in which the semicircular grooves formed in first frame and the second frame are combined with each other and being formed in the combined first frame and the second frame; and a vertical guide tunnel communicated with the vertical guide tunnel and formed by shielding an opening formed on a bottom surface of the second hinge arm upper portion by the second hinge arm lower portion.

Embodiments include the above and wherein the door opening unit comprises: a pusher stem assembly elastically supported on an inner side of the outer frame and fitted in a stem through-hole of the inner frame to be in contact with the cover; and a guide structure integrally formed on an inner side of the outer frame to guide the movement of the pusher stem assembly. Embodiments include the above and wherein the pusher stem assembly is supported and guided by the guide structure to apply stored elastic force to the cover, and is operable to move together with the door along a door opening direction by reaction of the elastic force when the door hanging and the door locking units are released.

Embodiments of the present invention are also drawn to a washing machine comprising: a cabinet; a tub disposed in the cabinet; a rear panel coupled to the cabinet and operable to be mounted on a vertical surface; a control unit disposed in a front surface of the rear panel with respect to an inner side of the cabinet; a front panel disposed in the tub; a cover disposed on the front panel and comprising: a door hinge on a first side; and a door locking unit on a second side; a door coupled to the door hinge; and an electronic door opening and closing device adapted for selectively locking or unlocking the door, wherein said electronic door opening and closing device comprises a door opening unit disposed on the door to rotate with the door and operable to store an elastic force therein when the door is closed, and wherein the door hinge comprises a cable guide tunnel adapted for guiding a cable therethrough, the cable for electrically connecting a circuit of the door to the control unit.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Hereinafter, specific embodiments of the present disclosure will be described in detail with reference to the drawings.

In addition, in the description of the present disclosure, the detailed description of known functions and configurations incorporated herein will be omitted if they would unnecessarily obscure the features of the subject matter of the present disclosure.

Figure 1:
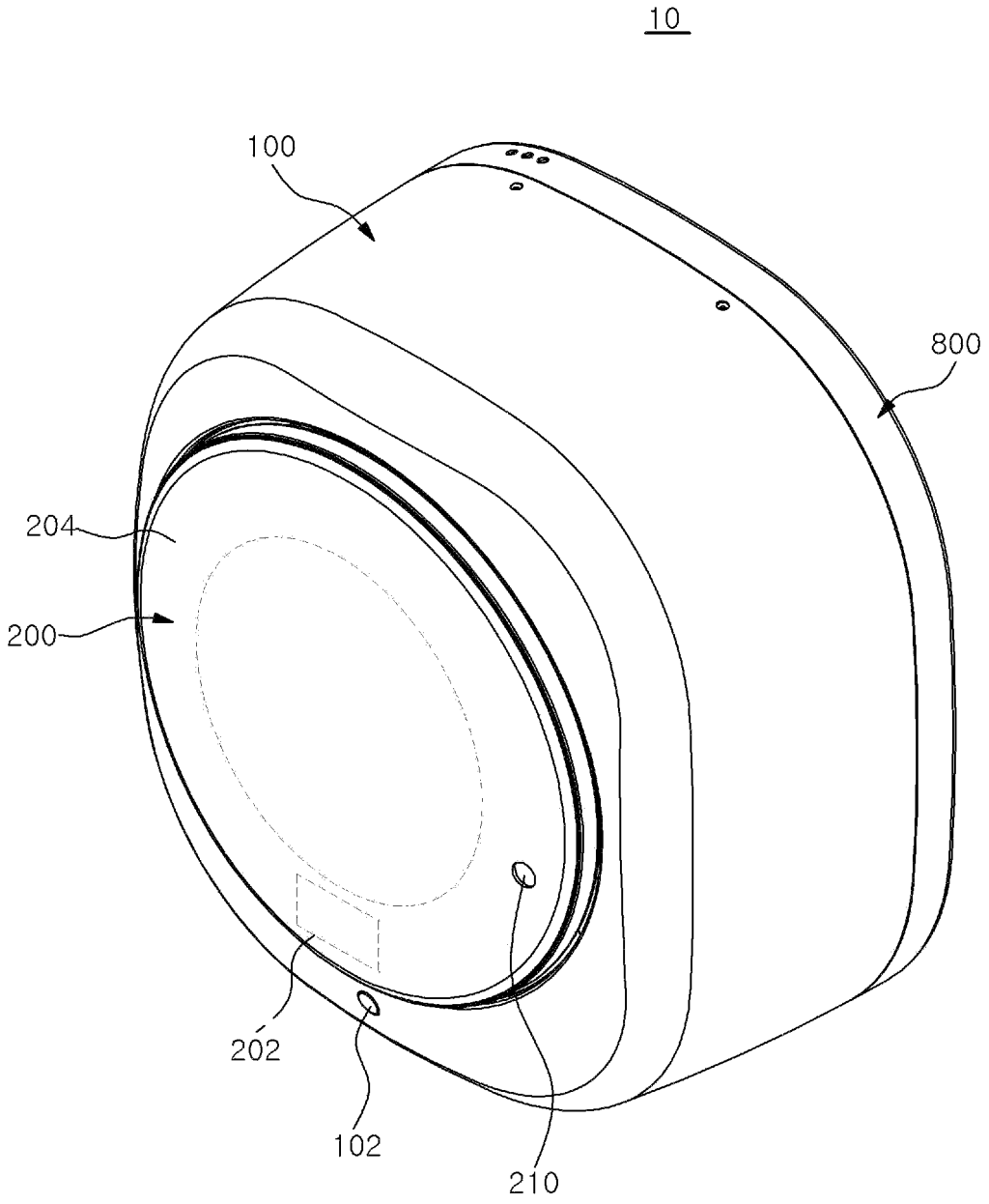
FIG. 1 is a perspective view showing the appearance of a wall mounted washing machine according to an embodiment of the present disclosure.
Figure 2:
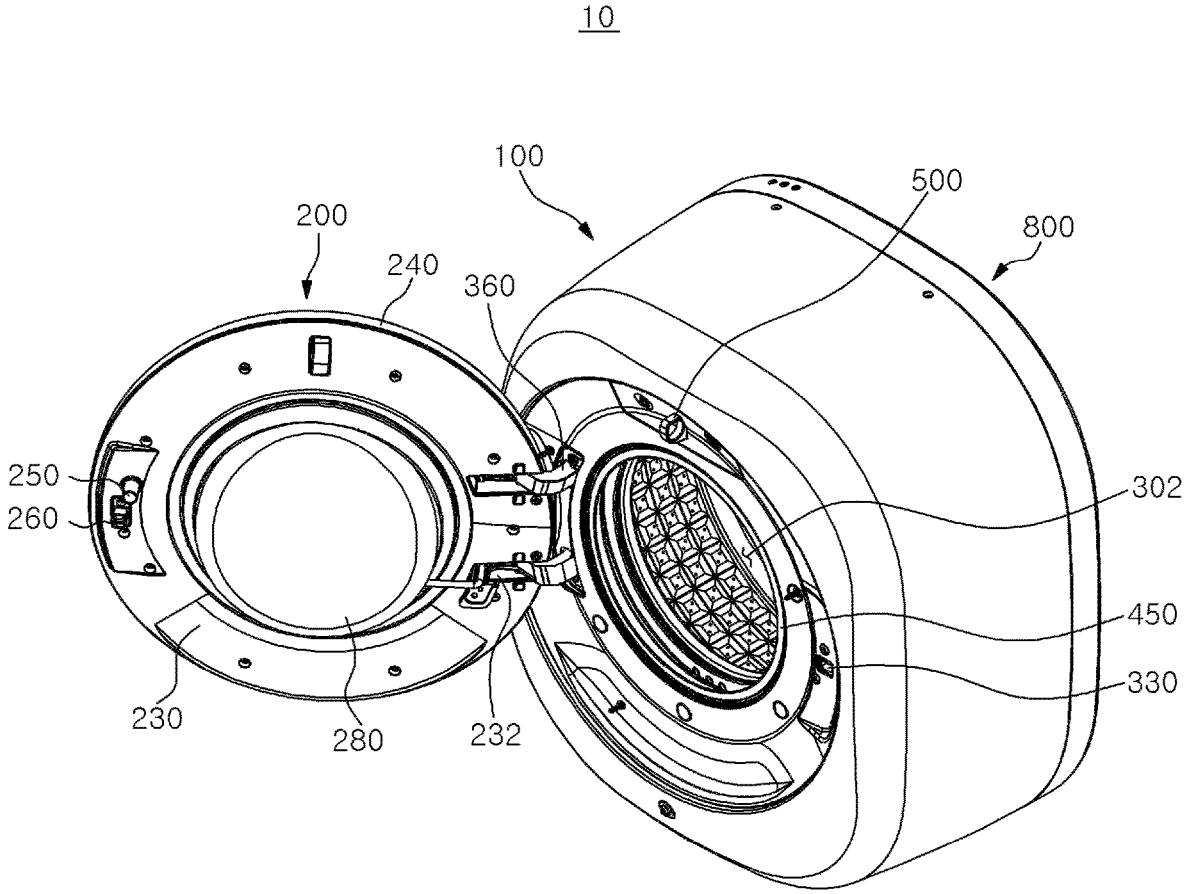
FIG. 2 is a view showing a state in which the door of FIG. 1 is opened.
Figure 3:
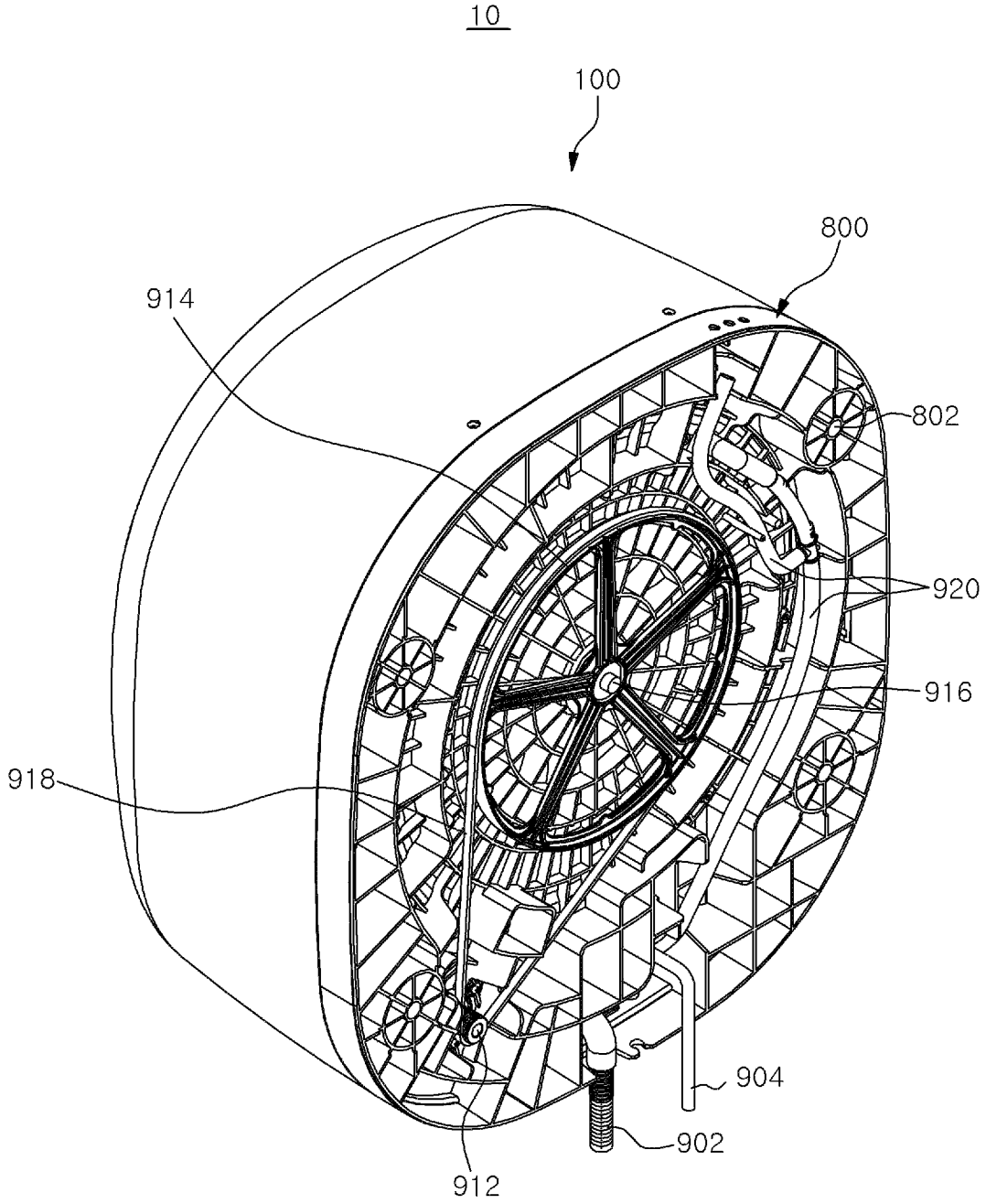
FIG. 3 is a rear perspective view of the washing machine of FIG. 1.
Figure 4:
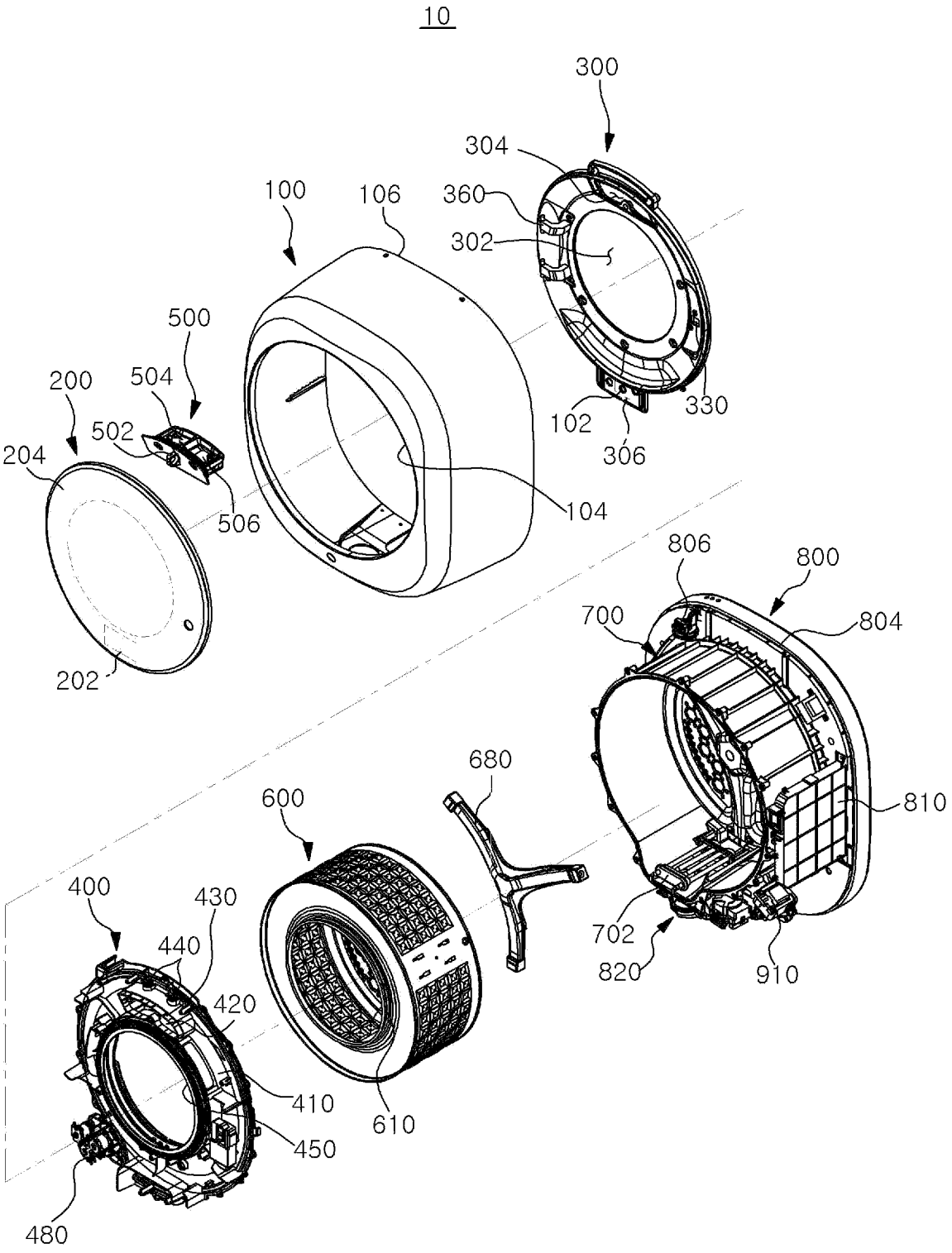
FIG. 4 is an exploded perspective view of the washing machine of FIG. 1.

FIG. 1 is a perspective view showing the appearance of a wall mounted washing machine according to an embodiment of the present disclosure, FIG. 2 is a view showing a state in which the door of FIG. 1 is opened, FIG. 3 is a rear perspective view of the washing machine of FIG. 1, and FIG. 4 is an exploded perspective view of the washing machine of FIG. 1.

Referring to FIGS. 1 to 4, a wall-mounted washing machine 10 according to an embodiment of the present disclosure may include a cabinet 100 having a front surface and a rear surface opened and forming an outer appearance or exterior shape thereof, a door 200 disposed on one side of the cabinet 100 and for opening or closing the opened front surface of the cabinet 100, a cover 300 connected to the door 200 for opening and closing the door 200, a front panel 400 disposed on the rear surface of the cover 300, a detergent container 500 housed in one side of the front panel 400 and accommodating detergent and conditioner, a drum 600 in which laundry is stored, a tub 700 which surrounds the drum 600 and is filled with wash water, and a rear panel 800 mounted on the wall. Here, the rear surface means a surface close to the wall, and the front surface means a surface opposite to the rear surface.

Specifically, the cabinet 100 may be provided in an empty form. Also, the cabinet 100 may include a power button 102 for controlling a power supply, a cover connection unit 104 connected to the cover 300, and a rear panel connection unit 106 connected to the rear panel 800.

The power button 102 may be provided on one side of the cabinet 100 to control whether the washing machine 10 is turned on or off. The power button 102 may be provided on one side of the front surface of the cabinet 100 to be easily controlled by the user. Here, in this embodiment, the power button 102 is provided on the lower surface of the front surface of the cabinet 100. However, the position of the power button 102 is not limited thereto, and may be provided on the left or right of the front surface of the cabinet 100, for example, or in other well known positions.

The cabinet 100 may include a cover connection unit 104 connected to the cover 300. The cover connection unit 104 may correspond to an edge of the opened front surface of the cabinet 100 and may have a smaller diameter than the diameter of the cover 300 so that the cover 300 is not detached from the cabinet 100. Specifically, the cover 300 may be inserted into the cabinet 100 from the rear surface to the front surface side. In this case, since the diameter of the cover connection unit 104 is smaller than the diameter of the cover 300, the cover 300 may be fitted into the cover connection unit 104, so that the cover 300 may not be separated from the cabinet 100.

The cabinet 100 may include a rear panel connecting unit 106 connected to the rear panel 800. The rear panel connecting unit 106 may correspond to the opened rear edge of the cabinet 100 and may have a shape that corresponds to the shape of the rear panel 800. The cabinet 100 may be bolted to the rear panel 800 and for this purpose, a plurality of bolt fastening holes may be formed in the rear panel connecting portion 106

Meanwhile, the door 200 may be provided on the front surface of the cabinet 100. The door 200 is provided for loading and unloading laundry, and may include a door inner frame 230 and a door outer frame 240. Specifically, the door inner frame 230 and the door outer frame 240 may be bolted in such way to offer a predetermined space therebetween, and each may be provided in a circular shape having a diameter corresponding to the cover connection unit 104. In this case, the door inner frame 230 may be in contact with the cover connection unit 104, and the door inner frame 230 and the door outer frame 240 may completely shield the cover 300 connected to the cabinet 100.

The door inner frame 230 and the door outer frame 240 may include a door hinge connection unit 232 for connection with the cover 300. The door hinge connecting unit 232 is provided at one side of the door inner frame 230 and the door outer frame 240 and may provide a space for accommodating a door hinge 360 of the cover 300 to be described later.

A display 202 may be provided in a space between the door inner frame 230 and the door outer frame 240. The display 202 is capable of outputting predetermined information to the user, and is provided with a front surface exposed to the outside of the door outer frame 240. That is, the door outer frame 240 may include a hole (not shown) or may be formed of a transparent material so that the display 202 may be viewed. In this case, the display 202 may include a touch panel capable of inputting or outputting information, and the user may view the panel to confirm information such as the operating state through the display 202, and also use the panel to perform operations of the wall-mounted washing machine 10 via touch interactions. For example, the user may select a process such as washing and rinsing of the laundry by performing a touch interaction with respect to the display 202, and confirm the remaining washing time or the like through the display 202.

The display 202 exposed to the exterior of the door outer frame 240 and the door outer frame 240 may be protected through a protective glass 204. The protective glass 204 is transparently provided on the front surface of the door outer frame 240 so that the user may identify the display 202. In this case, the protective glass 204 may be provided with the same diameter as the door inner frame 230 and the door outer frame 240.

A hole (not shown) may be provided on one side of the protective glass 204, and the door opening button 210 may be exposed to the outside through the hole (not shown). The door opening button 210 may be provided in the door outer frame 240 for opening or closing the interior of the cabinet 100 using an electronic opening and closing system and may be exposed to the outside through a hole of the protective glass 204.

In addition, the door 200 may include a door opening unit 250 and a door hanging unit 260. The door opening unit 250 and the door hanging unit 260 may protrude rearward of the door inner frame 230 and may be in contact with and engaged with one side of the cover 300. Specifically, the door opening unit 250 serves as an opening/closing assistant and may have an elastic force. For example, the door opening unit 250 may include a spring and may act as a support for opening the door 200 through the elastic force of the spring. For example, when the door 200 is closed, the door opening unit 250 may be compressed and inserted into a groove (not shown) provided on one side of the cover 300. When the user operates the door opening button 210 to open the door 200, the door opening unit 250 may be released from one side of the cover 300, and may be in contact with the bottom surface of the groove (not shown) provided on one side of the cover 300 in a relaxed state. That is, a space is provided between the door 200 and the cover 300 by the relaxed length of the door opening unit 250, thereby preventing the door 200 from being automatically closed.

The door opening unit 250 may be a pusher stem assembly that may be supported by the spring and located within a guide structure formed in the door inner frame 230 or repeatedly perform projecting by a linear movement through a predetermined stroke range.

The door hanging unit 260 may be provided at a predetermined distance from the door opening unit 250 and may be provided in the shape of a hook partially protruding from the door inner frame 230. The protruding portion of the door hanging unit 260 may be coupled to a door lock unit 330 of the cover 300 to be described later, and thus the door 200 may be closed.

In summary, the door 200 according to one embodiment of the present disclosure may be opened through a door opening button 210. When the user operates the door opening button 210, the door opening unit 250 and the door hanging unit 260 may be released from the cover 300 so that the door 200 may open the cover 300. In this case, the door opening unit 250 having an elastic force may be relaxed and provided on one side of the cover 300, and thus a predetermined gap is provided between the door 200 and the cover 300. Therefore the door 200 may be prevented from closing.

In addition, the user may close the door 200 by applying pressure to the door 200 toward the cover 300 side. To this end, the user may press one side of the outermost protective glass 204 of the door 200 so that the door opening unit 250 may be compressed and become received in the groove (not shown) of the cover 300 and the protruding portion of the door hanging unit 260 may be coupled to the door hanging unit 330 of the cover 300. That is, the door 200 may be opened and closed without a separate handle.

A center side of the door inner frame 230 and the door outer frame 240 may be opened and the door glass 280 may be provided at the opened center side. The door glass 280 allows the user to view the laundry inside the machine from the outside of the washing machine 10 and may be fitted to the door inner frame 230 and the door outer frame 240. In this case, the door glass 280 may be formed to protrude rearward, and the protruded side of the door glass 280 may be fitted to the opened side of the cover 300.

Meanwhile, the door 200 may be rotatably connected to the cover 300. The cover 300 is provided to enclose the front panel 400 and may include a laundry inlet 302 for loading the laundry, a detergent container loading port 304 for loading a detergent container 500, and a power processing unit 306 for controlling the button 102.

The user may load laundry through the laundry inlet 302. The laundry inlet 302 may be provided to have a predetermined diameter. In this case, the diameter of the laundry inlet 302 may correspond to the size of the protruding portion of the door glass 280. Thus, when the door 200 is closed, the door glass 280 may block the laundry inlet 302, and when the user opens the door 200, the door glass 280 is released from the laundry inlet 302 to allow laundry loading through the laundry inlet 302.

A detergent container loading port 304, which may load the detergent container 500, may be provided on the upper side of the laundry inlet 302. In this case, the detergent container loading port 304 may correspond to the shape of the detergent container 500.

The cover 300 may have a laundry inlet 302 at its center and may have a circular shape as a whole. Further, the cover 300 may be shaped such that one side protrudes downward. In this case, the power processing unit 306 may be provided in a protruding portion downward. The power processing unit 306 may be a PCB substrate connected to the power button 102 to control whether the power is turned on or off according to the operation of the power button 102 protruding from the outside of the case 100.

Meanwhile, the cover 300 may include a door hanging unit 330 located at a position corresponding to the other door hanging unit 260. The door hanging unit 330 is coupled to the hook-shaped door hanging unit 260 and may include a groove corresponding to the shape of the door hanging unit 260. Thus, as the door hanging unit 260 is coupled to the other door hanging unit 330, so that the door 200 may close the laundry inlet 302.

Also, the cover 300 may include a door hinge 360 at a location corresponding to the door hinge connection unit 232. The door hinge 360 may be opened while one side of the door 200 and one side of the cover 300 may be connected to each other, and the one side of the door hinge 360 may be received in the door hinge connection unit 232. Specifically, the door hinge 360 may be formed in a shape of a long curved panel in a vertical direction on one side of the laundry inlet 302, and may be partially protruded forward such that the door 200 may be rotated and connected to the door hinge connection unit 232. That is, the door 200 may be rotatable along the protruding portion in front of the door hinge 360.

Meanwhile, a front panel 400 may be provided on the rear surface of the cover 300. The front panel 400 may be coupled to the tub 700 and may include a shield unit 410 shielding a space between the drum 600 and the tub 700, a detergent container receiving unit 420 receiving the detergent container 500, a detergent container gasket 430 which provides a seal at a portion coupled with the detergent container 500, a fitting 440 for supplying water into the detergent container 500, a door gasket 450 which provides a seal at a portion in contact with the door 200, and a water supply valve assembly 480 for receiving wash water from an external water supplying source.

The shield unit 410 may shield a space generated between the drum 600 and the tub 700 and may have a shape corresponding to the shape of the cover 300. That is, it may have the same diameter as the cover 300 and have an opening corresponding to the laundry inlet 302 provided on the center side thereof. In this regard, the opening of the shield unit 410 may be smaller than the diameter of the drum 600, so that the space between the drum 600 and the tub 700 may be shielded.

The detergent container receiving unit 420 may be provided at one side of the shield unit 410 to receive the detergent container 500. The detergent container receiving unit 420 may have a shape corresponding to the shape of the detergent container 500 and may be in communication with the detergent container loading port 304 of the cover 300. That is, the detergent container 500 may be received in the detergent container receiving unit 420 via the detergent container loading port 304 of the cover 300.

The detergent container receiving unit 420 may include a detergent container gasket 430 that is pressurized by the detergent container 500. The detergent container gasket 430 may be disposed around the end of the detergent container receiving unit 420 to seal the detergent container 500 and may be composed of a rubber material. That is, the detergent, the conditioner, and the wash water supplied to the detergent container 500 are prevented from leaking to the outside through the detergent container gasket 430.

At least one fitting 440 may be provided on the top of the detergent container receiving unit 420. The fitting 440, which is connected to a water supply valve assembly 480 connected to an external water supply source, may supply the wash water into the detergent container 500. Thus, the wash water supplied to the drum 600 and the tub 700 may include the dissolved detergent or conditioner because the wash water is supplied into the drum 600 and the tub 700 through the detergent container 500.

Meanwhile, the opening of the shield unit 410 may include a door gasket 450 which is pressed by a door glass 280 of the door 200. The door gasket 450 may be disposed at the opening end of the shield unit 410 (for example, at the annular end of the opening) to hermetically fix the door glass 280, and it may be composed of a rubber material or the like. Thus, when the door 200 is closed, the door glass 280 penetrating the laundry inlet 302 of the cover 300 presses the door gasket 450, and therefore the wash water inside the drum 600 and the tub 700 will not leak outside the door 200.

The fitting 440 may be supplied with wash water through a water supply valve assembly 480. The water supply valve assembly 480 may be connected to an external water supply source and may selectively supply the wash water to the detergent container 550 through the fitting 440. The water supply valve assembly 480 may be a three-way valve and two of the supply flow paths extending from the water supply valve assembly 480 may be connected to the fitting 440 connected to the detergent container 500 and one of them may supply the wash water to the drum 600 directly through the door gasket 450.

The detergent container 500 may accommodate detergent and conditioner and may include a detergent container handle 502, a detergent input space 504 in which detergent is loaded, and a conditioner input space 506 in which a conditioner is loaded.

The detergent container handle 502 may protrude forward and may be exposed to the outside of the cover 300. The user thus may grasp the detergent container handle 502 after opening the door 200, allowing the detergent container 500 to be unloaded or inserted from the detergent container receiving unit 420. In this embodiment, although the detergent container handle 502 is extended in the vertical direction and provided at the center of the front surface of the detergent container 500, the detergent container handle 502 is not limited thereto. For example, the detergent container receiving unit 420 may be extended in the horizontal direction and provided on the front surface of the detergent container 500.

The detergent container 500 may be partitioned based on the center of the interior and include a detergent input space 504 and a conditioner input space 506 which may contain detergent and conditioner, respectively. In this connection, the fitting 440 may be arranged to correspond with the detergent input space 504 and the conditioner input space 506, and the detergent and conditioner in the detergent input space 504 and the conditioner input space 506 may be supplied with the wash water. Specifically, the user may draw the detergent container 500 from the detergent container receiving unit 420 after opening the door 200 and may fill detergent and conditioner into the detergent input space 504 and the conditioner input space 506, respectively. The detergent container 500 filled with the detergent and the conditioner may be inserted again into the detergent container receiving unit 420, and depending on the washing process, the detergent input space 504 and the conditioner input space 506 may be supplied with the wash water. Accordingly, the wash water including detergent or conditioner may be selectively supplied to the drum 600 and the tub 700.

Meanwhile, the front panel 400 may be connected to the drum 600. The drum 600 for receiving the laundry may include a drum inlet portion 610 on the front surface and a spider 680 on the rear surface. In this case, a plurality of holes may be formed around the drum 600 for fluid communication with the tub 700.

A drum inlet portion 610 may correspond to the opened portion of the shield unit 410. In this regard, the drum inlet portion 610 may have a diameter smaller than the entire diameter of the drum 600, and the drum inlet portion 610 may be fitted into the opened portion of the shield unit 410, so that front panel 400 and the drum 600 may be connected to each other. Thus, the laundry may be loaded into the drum 600 via the laundry inlet 302 of the cover 300 and the opened portion of the front panel 400.

The drum 600 may be rotated through a spider 680. The spider 680 may rotate in response to a driving force from a driving motor 910 (to be described later). The spider 680 may be separate from the drum 600 and also coupled to the rear surface of the drum 600. In this case, a groove corresponding to the shape of the spider 680 may be formed on the rear surface of the drum 600 so that the spider 680 may be seated.

The spider 680 may include a plurality of arms extending in different directions with a constant gap at the center. For example, the spider 680 may include an arm extending in three directions by a length corresponding to the radius of the drum 600, and each arm may be disposed at a 120-degree gap. Further, the center of the spider 680 may be fixed to a second pulley 914 (to be described later) through a drum rotation axis 916 to be described later, and thus both the drum 600 coupled to the spider 680 and the spider 680 may be rotated. A specific method of rotating the drum 600 will be described later.

A tub 700 in which the wash water is filled may be provided outside the drum 600. The tub 700 may have a shape corresponding to the drum 600 and may be formed with a diameter larger than a diameter of the drum 600 by a predetermined length. Accordingly, the tub 700 may be arranged apart from the drum 600 by a predetermined gap. In addition, the wash water supplied into the tub 700 may flow into the drum 600 through a plurality of holes formed around the drum 600. Similarly, the inner wash water of the drum 600 may flow into the tub 700 through the plurality of holes formed around the drum 600. In this regard, the drum 600 and the tub 700 may be provided in a cylindrical shape, but of course are not limited thereto.

Further, the tub 700 may include a heater 702 to heat the wash water. Specifically, a groove may be formed on the inner side of the tub 700 to receive the heater 702, and a heater 702 may be provided on the inner side of the tub 700 in a detachable manner. Thus, the heater 702 may heat the wash water filled in the tub 700.

Meanwhile, the tub 700 may be integrally provided with a rear panel 800. The rear panel 800 may be mounted on the wall and may include an anchor connection unit 802 to which an anchor (for mounting to the wall) is connected, a cabinet fixing unit 804 for fixing the cabinet 100, and a sensor 806 for detecting the water level.

Specifically, the tub 700 and the rear panel 800 may be integrally injection molded, and the tub 700 may protrude from the front of the rear panel 800. The rear surface of the rear panel 800 may be mounted on the wall via a separate anchor. The anchor may be coupled to the wall through an anchor connection unit 802 and may be provided on the rear surface of the rear panel 800 for stable engagement. That is, the plurality of anchors may mount the rear panel 800 on the wall. In this case, since the tub 700 and the rear panel 800 are integrally provided, a separate damper or an elastic member for supporting the tub 700 is not required. Consequently, the number of parts may be reduced, and the size of the washing machine 10 may be likewise reduced.

The cabinet 100 may be coupled to the front surface of the rear panel 800 where the tub 700 is provided to enclose the tub 700. In this case, a cabinet fixing unit 804 may be provided to have a stepped shape along the periphery of the rear panel 800, and the cabinet 100 may be fixed to the cabinet fixing unit 804. For this purpose, a fastening member such as a bolt may be used.

Also, the rear panel 800 may include a control unit 810 for controlling the overall functions of the wall mounted washing machine 10 and a drain unit 820 for discharging the wash water filled in the tub 700.

The control unit 810 may be provided on the front surface of the rear panel 800 to control various components of the wall mounted washing machine 10 depending on a user's operation to perform laundry washing. In this embodiment, while the control unit 810 is shown on the right side of the respect to tub 700, the position of the control unit 810 is not limited thereto.

A power supply line 904 may be connected to the external power source to supply power to the electric equipment, the control unit 810, the driving motor 910, and the like described above. The power supply line 904 may extend through the rear panel 800 to the front of the rear panel 800 and may extend outwardly from the rear of the rear panel 800. In this case, the power supply line 904 may be fixed to the rear surface of the rear panel 800 through a separate fixing means. As the power supply line 904 is provided extending outwardly from the rear surface of the rear panel 800, the washing machine 10 may have a finished or pleasing appearance.

The drain unit 820 may be provided under the rear panel 800. The drain unit 820 may discharge any wash water inside the tub 700 to the outside and may be disposed on the lower surface of the front surface of the rear panel 800. In this case, the drain unit 820 may include a drain pump for pressurizing the wash water and may be connected to the drain hose 902 to discharge the wash water. Specifically, the drain hose 902 is connected to the drain unit 820 and extends outward along the rear surface of the rear panel 800, so that the wash water may flow through the pressure of the drain unit 820. Thus, when the drain unit 820 is operated after the washing cycle is completed, the wash water may be discharged to the outside of the cabinet 100 through the drain hose 902 under the pressure change of the drain unit 820.

Meanwhile, the rear panel 800 may include a driving motor 910 for transmitting a driving force to the rear panel 800, a first pulley 912 and a second pulley 914 connected to the driving motor 910, a drum rotational shaft 916 connected to the second pulley 914 to rotate the drum 600, and a belt 918 that connects the first pulley 912 and the second pulley 914.

Specifically, the driving motor 910 may be provided on the front surface of the rear panel 800. The driving motor 910 may be controlled by the control unit 810 and may be provided on one side of the control unit 810 and the drain unit 820.

Also, the driving motor 910 may be connected to the first pulley 912. In this case, the shaft (not shown) of the driving motor 910 may be provided through the rear panel 800 and may be connected with a shaft (not shown) of the driving motor 910 to the first pulley 912 at the rear surface of the rear panel 800.

The first pulley 912 may be connected to the second pulley 914 via a belt 918. The second pulley 914 may be provided to surround the drum rotation shaft 916 connected to the spider 680 and the drum rotation axis 916 may penetrate the rear panel 800 while being connected to the spider 680. That is, the second pulley 914 and the drum rotation shaft 916 may be connected to each other at the rear surface of the rear panel 800.

In summary, when the wash water is filled in the tub 700 through the fitting 440, the control unit 810 may operate the driving motor 910. Subsequently, the first pulley 912 connected to the driving motor 910 may be rotated, and the second pulley 914 may be then rotated by the rotation of the first pulley 912. Thus, the drum rotation shaft 916 connected to the second pulley 914 may also rotate so that the drum 600 may be rotated inside the cabinet 100 and the tub 700. Consequently, the laundry inside the drum 600 may be washed.

On the other hand, the rear panel 800 may further include an exhaust line 920. The exhaust line 920 may be connected to the drain unit 820 and may exhaust air inside the tub 700 and the drain unit 820. Specifically, the exhaust line 920 may be connected to the drain hose 902 and pass through the rear panel 800, through which it may extend to the rear surface of the rear panel 800 and be exhausted to the outside.

The wall-mounted washing machine 10 according to an embodiment of the present disclosure may be used as follows.

First, the user may open the door 200, and may load the laundry inside the drum 600 and unload the detergent container 500 from the front panel 400. In this case, the detergent container 500 is divided in the center, so that a space for loading detergent and conditioner, respectively, may be provided.

After inserting the detergent container 500 loaded with the detergent and conditioner back into the front panel 400, the user may close the door 200 and control the laundry operation via the power button 102 and the display 202.

When the washing cycle is started, the wash water provided from an external water supplying source through the water supply valve assembly 480 may be supplied to the detergent container 500 through the fitting 440, and the wash water may be supplied into the drum 600 and tub 700 after passing the detergent input space 504 and the conditioner input space 506. That is, the wash water filled in the drum 600 and the tub 700 may optionally include detergent and conditioner.

When the tub 700 is fully filed with the wash water, the control unit 810 may drive the driving motor 910. In this case, the driving motor 910 may be connected to the first pulley 912 and the second pulley 914, and the second pulley 914 may be connected to the drum 600 through the drum rotation shaft 916. Thus, the drum 600 may be rotated through the driving motor 910. Consequently, the laundry loaded in the drum 600 may be easily washed by the rotation of the drum 600.

When the door 200 is closed, the door 200 may rotate toward the cover 300, and when the door 200 is opened, the door 200 may be reversely rotate away from the cover 300.

Figure 5:
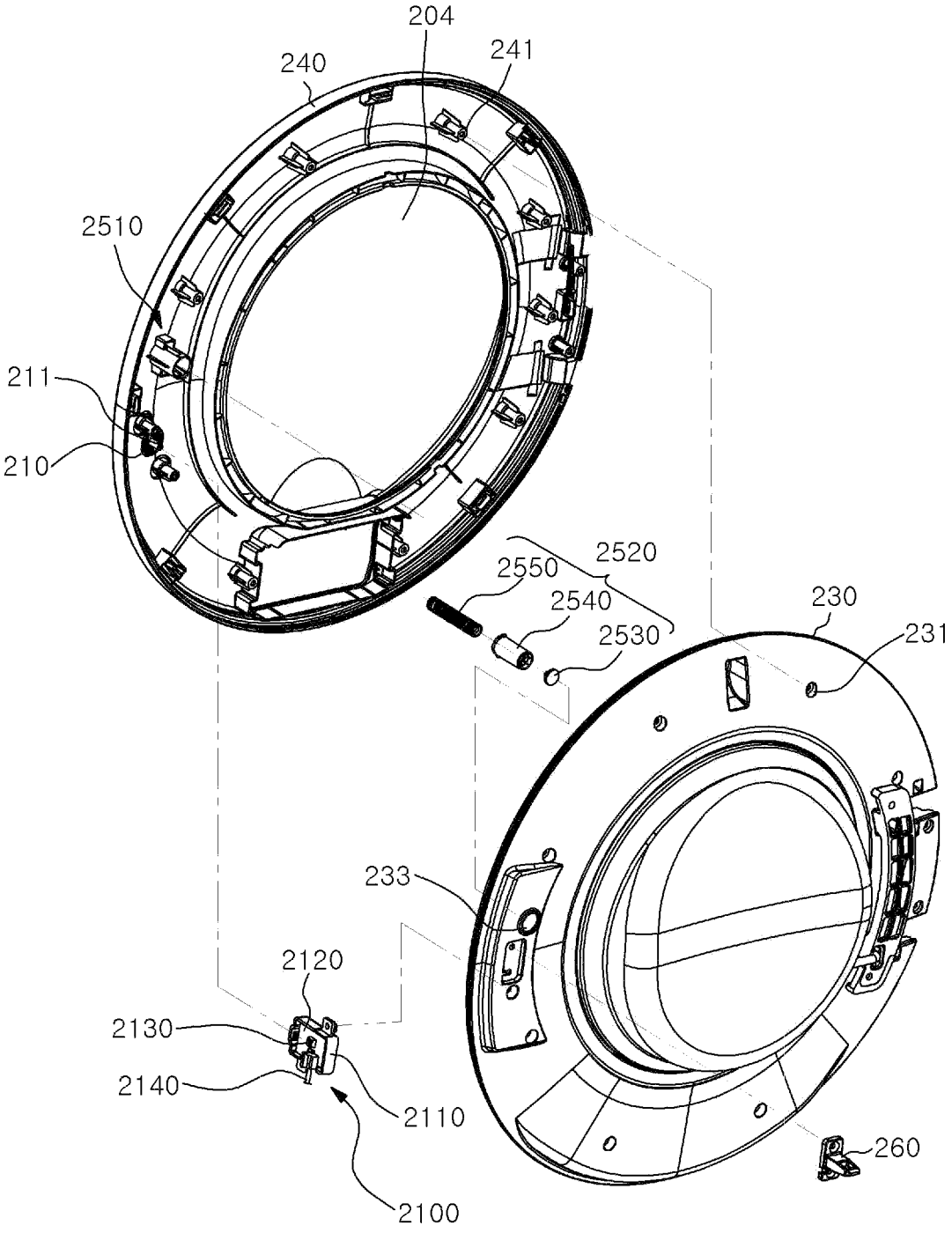
FIG. 5 is an exploded perspective view of a door to illustrate a door opening and closing device mounted on the door in FIG. 2.
Figure 6:
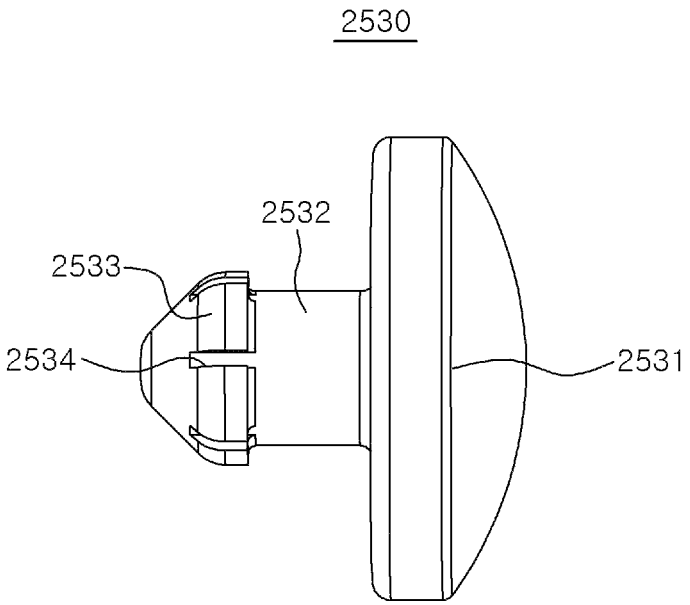
FIG. 6 is a front view of a cushion of the door opening unit shown in FIG. 5.
Figure 7:
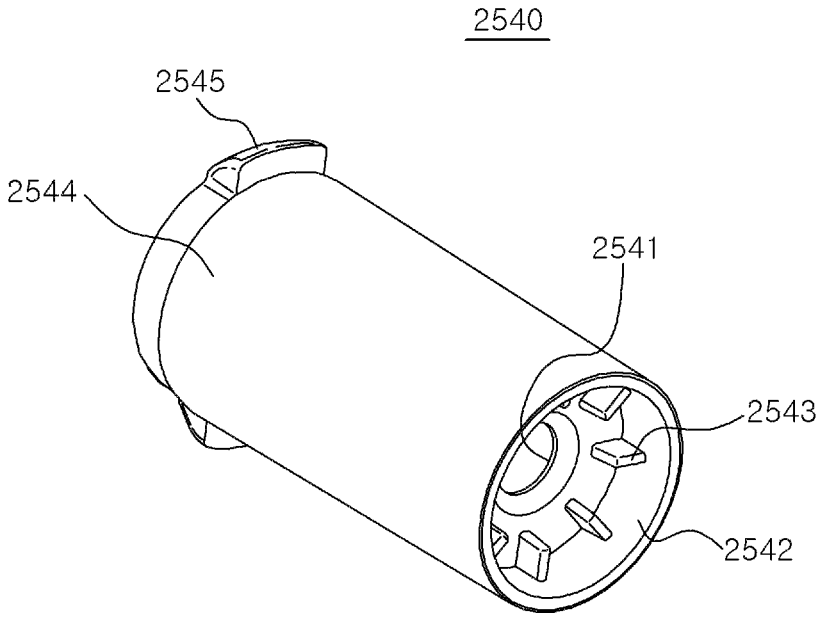
FIG. 7 is a perspective view of a stem of the door opening unit shown in FIG. 5.
Figure 8:
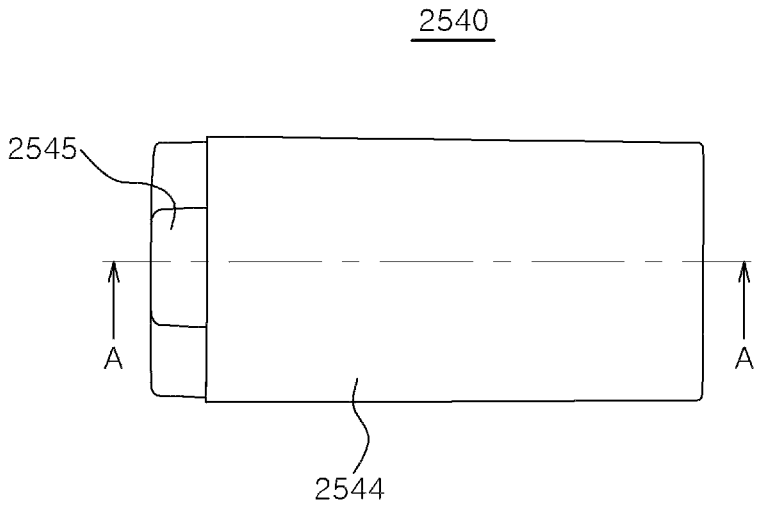
FIG. 8 is a front view of the stem shown in FIG. 7.
Figure 9:
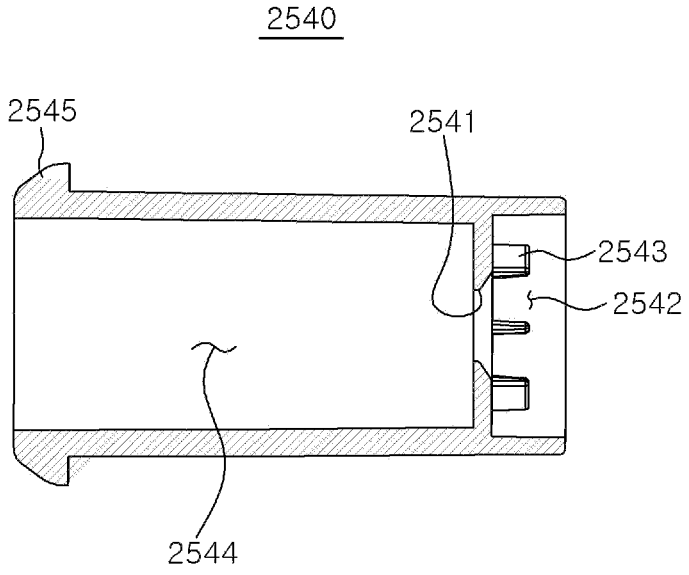
FIG. 9 is a sectional view taken along line A-A of the stem shown in FIG. 8.
Figure 10:
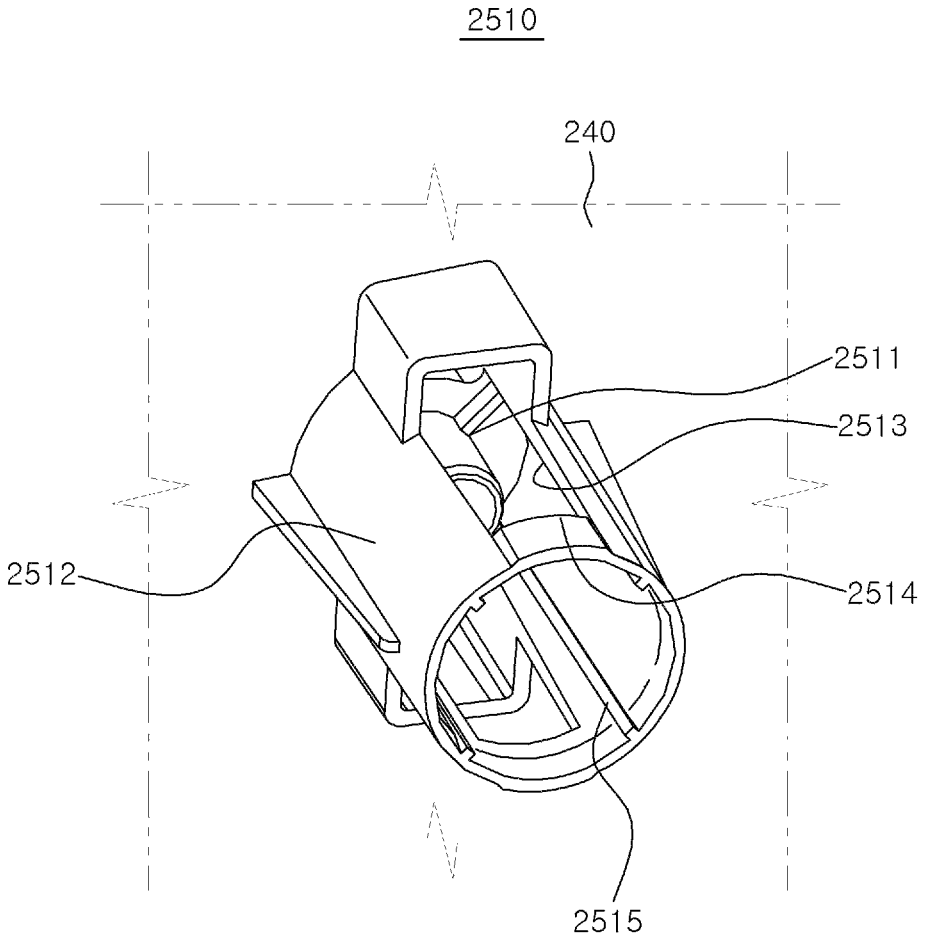
FIG. 10 is a perspective view of a guide structure of the door opening unit shown in FIG. 5.

FIG. 5 is an exploded perspective view of a door to illustrate a door opening and closing device mounted on the door in FIG. 2, and FIG. 6 is a front view of a cushion of the door opening unit shown in FIG. 5. Further, FIG. 7 is a perspective view of a stem of the door opening unit shown in FIG. 5, and FIG. 8 is a front view of the stem shown in FIG. 7. Further, FIG. 9 is a sectional view taken along line VX-VX of the stem shown in FIG. 8, and FIG. 10 is a perspective view of a guide structure of the door opening unit shown in FIG. 5.

Referring to FIGS. 5 to 10, the wall mounted washing machine includes a door opening and closing device which may be of an electronic opening and closing type and is disposed on the door 200.

The door 200 includes a door inner frame 230 and a door outer frame 240 configured to be separated or assembled as described above. The door 200 may be an assembly which includes the inner frame 230 and the door outer frame 240 which are assembled together.

The door opening and closing device may be an electronic device capable of opening the door 200 in accordance with an embodiment. That is, even if the door opening button 210 is simply pressed by the user's finger, the locking state of the door 200 may be released, thereby facilitating user convenience. In addition, the door opening and closing device allows the door 200 to be opened easily and quickly.

For example, the door opening and closing device may readily open the door 200 by utilizing a resultant force summing an elastic force of the door opening unit 250 including the pusher stem assembly 2520 and the elastic force of the door gasket 450 of FIG. 4, e.g., a bending force.

For example, the door gasket 450 has an elastic protrusion protruding obliquely toward the door glass 280, and is bent when the door 200 is closed which applies the elastic force, such as a bending force, to the door 200 through a door glass 280.

In other words, in the unlocking state in which the door 200 may be opened, the elastic protrusion of the door gasket 450 may be restored to the original state, and the door 200 may be pushed by an elastic force corresponding to the bending force. In this situation, the acting direction of the elastic force of the door gasket 450 may be the same as the acting direction of the elastic force of the door opening unit 250, so that the door 200 may open quickly.

The door opening and closing device may include the door opening unit 250, the door locking unit 330 and the door hinge 360, as shown in FIG. 4; and the door opening and closing device may further include a door hanging unit 260, an opening button circuit module 2100 and a door opening button 210, as shown in FIG. 5.

The door hinge 360 may be disposed on one side of the cover 300 and may be rotatably coupled to the door 200.

The door locking unit 330 may be provided on the other side of the cover 300.

The door hanging unit 260 may be made of a metal material having a larger structural strength than that of the door 200, and is detachably attached to the door 200 by a fastening means such as a bolt.

For example, the door hanging unit 260 is mounted on the door 200. That is, the door hanging unit 260 may be in the form of a hook protruding out of the door inner frame 230, or in the form of a ring protruding from the door inner frame 230 toward the cover 300. The door hanging unit 260 may be a component (e.g., locking component) coupled to the door locking unit 330 of FIG. 3 or FIG. 4 mentioned above or may be a component (e.g., unlocking component) unlocking from the door locking unit.

The door locking unit 330 may be a device capable of locking or unlocking the door hanging unit 260 using an elastic force and an electromagnetic force, in one embodiment.

The door locking unit 330 may unlock the door hanging unit 260 depending on the door lock release signal from the control unit 810 or may unlock the door hanging unit 260 by a manual lock release as described below.

The door locking unit 330 is disposed on the cover 300. The door locking unit 330 may lock the door hanging unit 260 when the door locking unit 330 is coupled to the door hanging unit 260.

To this end, the door locking unit 330 is connected to a control unit 810 in the washing machine 10. In a detailed configuration, the door locking unit 330 may be an electromechanical locking device having a latch for locking or unlocking the door hanging unit 260 and a mechanism for operating the latch and an electrical powering device. Here, the electric power unit is configured to be controllable by the control unit 810.

As such, the door locking unit 330 may release the locking state of the door hanging unit 260 in response to an operation control event, such as a door unlocking signal of the control unit 810 located in the cabinet 100.

The door opening unit 250 is installed in the door 200 as mentioned above. The door opening unit 250 rotates together with the door 200 to contact the cover 300. Subsequently, the spring 2550 of the door opening unit 250 is compressed, so that an elastic force may be generated in the spring 2550 or stored in the spring 2550.

Further, the door opening unit 250 may include a guide structure 2510 described below and a pusher stem assembly 2520 guided by a guide structure 2510.

In addition, the door opening unit 250 may play a role of generating a force required to open the door 200. For example, the door opening unit 250 is a device that may be stretched or contracted, e.g., that may be capable of expansion and contraction within a predetermined stroke range using an elastic force. In other words, the door opening unit 250 may serve as a pusher device for easily and rapidly opening the door 200 using an elastic force. That is, the door opening unit 250 may reverse the door by the stored elastic force.

Moreover, the door opening unit 250 may serve as an elastic support or a spacer. That is, in an open state of the door 200, the door opening unit 250 may maintain a space between the door 200 and the cover 300 until the user applies a force to the door of a sufficient magnitude to close the door 200.

To this end, the door opening unit 250 is installed on the door 200 with respect to a position spaced apart from the door hanging unit 260.

The door inner frame 230 is arranged toward the cover 300 and has a plurality of bolt holes 231 and a stem through hole 233. The stem through hole 233 is formed so that it passes through along a direction in accordance with the frame thickness (e.g., the frame thickness direction) of the door inner frame 230 with respect to a position spaced from the door hanging unit 260.

A protective glass 204 is coupled to the outer side of the outer frame 240.

The door outer frame 240 may be act as a support base of the door opening unit 250.

The door outer frame 240 is coupled to the door inner frame 230 through a bolt (not shown) corresponding to the bolt hole 231. For this purpose, the door outer frame 240 includes a plurality of bolt fixing parts 241 spaced apart from one another along the circumferential direction from the inner side of the door outer frame 240 so that the bolts inserted into the bolt holes 231 are coupled to the bolt fixing parts.

The door outer frame 240 includes a door opening button 210 disposed in the door outer frame 240, in one instance, with respect to a position that does not interfere with the bolt fixing part 241.

The outer side of the door opening button 210 may be exposed through a hole (not shown) on one side of the protective glass 204, as mentioned above.

The door opening button 210 includes a button extending portion 211 that is an integral shaft member protruding from the center of the inner side thereof toward the inner side of the door inner frame 230.

A swirling elastic body is formed between an outer edge of the door opening button 210 and an inner edge of a button hole edge of the door inner frame 230.

Accordingly, the user may perform a pressing operation for opening the door 200, such as pressing the door opening button 210 on the outside of the door 200 with a finger. Then, since the swirling elastic body is deformed within the elastic range, the door opening button 210 and the button extending portion 211 may be advanced during the pressing operation, and may be restored (e.g., backward) to the original state when the finger releases the door opening button 210.

Meanwhile, the door inner frame 230 includes an opening button circuit module 2100 installed on the inner side of the door inner frame 230 to be in contact with the end of the button extending portion 211.

The opening button circuit module 2100 is installed at a position, e.g., the inner side of the door inner frame 230, spaced downwardly away from the stem through hole 233 of the door inner frame 230.

The opening button circuit module 2100 has a circuit housing 2110 that may be bolted to the inner side mounting position of the door inner frame 230. One side of the circuit housing 2110 is open.

The opening button circuit module 2100 includes a switch circuit board unit 2120 installed on the circuit housing 2110 through the open side. Here, the opening button circuit module 2100 perform the function of issuing the locking release signal to the control unit 810 of the washing machine 10 according to a selective ON or OFF operation of the door opening button 210, the button extension portion 211 and a contact switch 2130. The contact switch 2130 may be mounted on the switch circuit board unit 2120 and may be in contact with the end of the button extending portion 211.

The opening button circuit module 2110 includes a cable 2140 (or signal wire) for electrically connecting the switch circuit board unit 2120 and the control unit 810. Herein, the cable 2140 may be connected to the control unit 810 via a circuit (not shown) associated with the display 202 mentioned above.

The door opening unit 250 will be described below in detail.

The guide structure 2510 of the door opening unit 250 serves to guide the movement of the pusher stem assembly 2520. The guide structure 2510 may be integrally formed on the inner side of the door outer frame 240. More specifically, the guide structure 2510 serves to guide the forward (e.g., stretch) or backward (e.g., collapse) movement of a stem 2540 of the pusher stem assembly 2520. The guide structure 2510 also serves to restrain or protect the spring 2550 so that the spring 2550 is selectively separated, or not separated, from the outside of the stem 2540.

The pusher stem assembly 2520 of the door opening unit 250 may be coupled to the guide structure 2510 and elastically supported on the inner side of the door outer frame 240. The cushion 2530 of the pusher stem assembly 2520 may be in contact with the cover 300. The stem 2540 of the pusher stem assembly 2520 may be fitted into the stem through hole 233 of the door inner frame 230.

The pusher stem assembly 2520 may be compressed upon contacting the cover 300.

Figure 11:
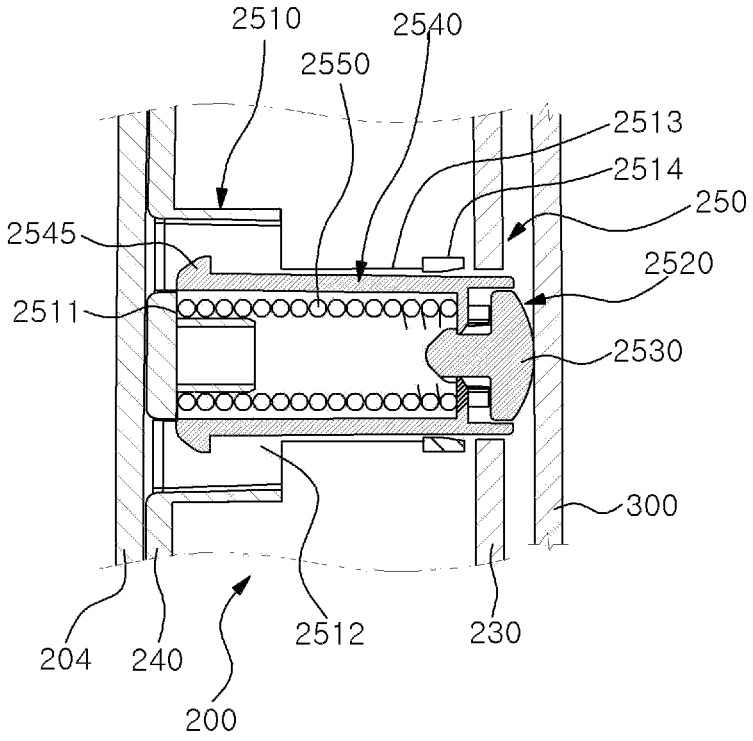
FIG. 11 is a sectional view showing an assembly state of the door opening unit shown in FIG. 5.
Figure 12:
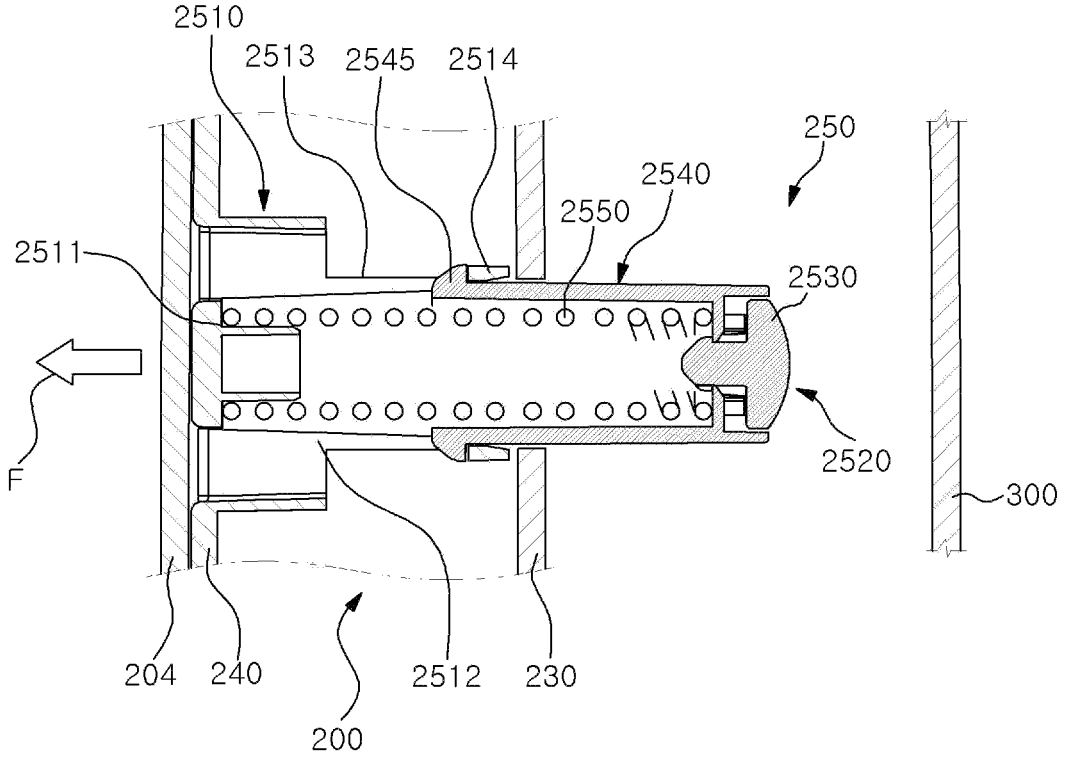
FIG. 12 is a sectional view showing an operating state of the door opening unit shown in FIG. 11.

FIG. 11 is a sectional view showing an assembly state of the door opening unit shown in FIG. 5, and FIG. 12 is a sectional view showing an operating state of the door opening unit shown in FIG. 11.

As shown in FIG. 11, the pusher stem assembly 2520 may be supported and guided within a guide structure 2510 as the door 200 is closed, and may act on the cover 300 with an elastic force stored in accordance with the compression of the spring 2550.

Conversely, the pusher stem assembly 2520 may extend toward the cover 300 through the stem through hole 233, as shown in FIG. 12, as the door 200 is opened. The pusher stem assembly 250 is supported and guided by the guide structure 2510 and acts on the cover 300 with a stored elastic force.

The cover 300 may be a fixed component of the washing machine 10 supported on the wall in one embodiment. The door 200 is a rotatable component in the door hinge 360 of the cover 300.

Therefore, the pusher stem assembly 2520 may be moved along with the door 200 along the door opening direction, as indicated by an arrow "F", due to a reaction (for example, an elastic repulsive force) caused by the elastic force as the spring 2550 is relaxed or elongated, as shown in FIG. 12, and in a state in which the door 200 is opened due to the locking release between the door hanging unit 260 and the door locking unit 330.

The pusher stem assembly 2520 includes a cushion 2530 that contacts the cover 300 in response to the rotation of the door 200. The pusher stem assembly 2520 includes a spring 2550 inserted into the stem 2540 and selectively compressed or relaxed along the longitudinal direction of the stem 2540.

Referring to FIG. 6, the cushion 2530 serves to attenuate and reduce impact amount and noise upon contacting the cover 300 to increase the operating quality of the washing machine 10.

For this purpose, the cushion 2530 is formed of at least one material selected from the group consisting of: a natural rubber material; a synthetic rubber material; a urethane material; a silicone material; and a synthetic resin material having an elastic force.

In addition, the cushion 2530 has a hemispherical contact portion 2531 that contacts the cover 300 to absorb impacts and has a bulged front surface. Although the contact portion 2531 has a shape in which a hemispherical portion is bulged in a disk-shaped body, the shape may not be limited to such a specific shape because it may be variously deformed for the purpose of absorbing impact or reducing noise in other ways.

In addition, the cushion 2530 has a cushion extension shaft portion 2532 protruding from the center of the rear surface of the contact portion and which shaft portion 2532 has a smaller diameter than the contact portion 2531.

Further, the cushion 2530 includes a cushion fixing part 2533 which is integrally formed at the end of the cushion extension shaft portion 2532 with respect to the position opposite to the contact portion 2531 and is fixed by hanging at the edge of the installation hole 2541 of the stem 2540 of FIG. 7.

Here, the cushion fixing part 2533 has a wedge section shape. The installation hole 2541 also has a dish hole shape corresponding to a wedge inclined surface of the cushion fixing part 2533. Also, the outer circumferential surface of the cushion fixing part 2533 is formed with a plurality of gap portions 2534 spaced apart from one another along the circumferential direction of the cushion fixing part 2533.

Thus, when the cushion 2530 is coupled to the stem 2540, the cushion fixing part 2533 may easily be passed through and fixed to the installation hole 2541 of the stem 2540.

The cushion 2530 is installed in a hollow stem 2540, for example, in a cushion inserting part 2542 of the stem 2540.

Referring to FIGS. 7 to 9, the stem 2540 includes the cushion inserting part 2542 formed on one side of the stem 2540 with respect to the installation hole 2541. Here, the cushion inserting part 2542 has a plurality of supporting protrusions 2543 for supporting the cushion 2530.

The spaces between the supporting protrusions 2543 allow the weight of the pusher stem assembly 2520 to be lightened while increasing impact damping and noise reduction efficiency as a means for allowing deformation of the cushion 2530.

In addition, the stem 2540 includes a hollow spring inserting part 2544 which extends integrally along the longitudinal direction of the stem 2540 from the cushion inserting part 2542 and is disposed on the other side of the stem 2540 with respect to the installation hole 2541. The spring 2550 of FIG. 5 is inserted into the inner space of the spring inserting part 2544.

The spring 2550 contacts the edge portion of the installation hole 2541 in the stem 2540. In addition, the end of the spring 2550 projected outward from the stem 2540 is supported in the spring supporting part 2511 of the guide structure 2510 as will be described below. As a result, the spring 2550 elastically supports the stem 2540 while being compressed or relaxed.

In addition, the stem 2540 includes a plurality of hanging protrusions 2545 protruding along a radial direction from the outer circumferential surface of the spring inserting part 2544 in a mutually opposing manner.

The hanging protrusions 2545 have a wedge cross-sectional shape inclined with respect to the direction of fastening to the guide body 2512 of the guide structure 2510. The wedge shape of the hanging protrusions 2545 allows the stem 2540 to be easily inserted and engaged in the guide body 2512.

Referring to FIG. 10, the guide structure 2510 is formed on the inner side of the door outer frame 240 to coincide with the center line of the stem through hole 233, and includes a spring supporting part 2511 supporting the end of the spring 2550 as shown in FIG. 11. Here, the spring supporting part 2511 is formed on the inner side of the door outer frame 240. The spring supporting part 2511 serves as a mounting position of the spring 2550 and transmits the elastic force of the spring 2550 to the door 200.

In addition, the guide structure 2510 is formed on the inner side of the door outer frame 240 with respect to the outer position of the spring supporting part 2511 and includes a hollow guide body 2512 into which the stem 2540 is inserted.

In addition, the guide structure 2510 includes guide slits 2513 coupled to the hanging protrusions 2545 of the stem 2540, respectively, and formed on a wall of the guide body 2512 to guide movement of the stem 2540.

In addition, the guide structure 2510 includes stoppers 2514 formed between the guide slits 2513 and the end of the guide body 2512.

The stem 2540 may be moved or stopped within the stroke range allowed in the guide structure 2510 by the guide slits 2513, the stoppers 2514 and the hanging protrusions 2545.

In addition, the guide structure 2510 includes a plurality of sliding protrusions 2515 spaced along the circumferential direction from the inner circumferential surface of the guide body 2512 and extending in the longitudinal direction of the guide body 2512.

The sliding protrusions 2515 reduce frictional force due to the movement of the stem 2540, thereby smoothly inducing the operation of the stem 2540. That is, the sliding protrusions 2515 may minimize the contact area between the guide body 2512 and the stem 2540. As a result, the stem 2540 may not become easily fixed or stuck within the guide body 2512 by sliding, and therefore minimizing any malfunction of the stem 2540.

Hereinafter, an operation method of the door opening and closing device of the wall-mounted washing machine according to the disclosure will be described.

Referring to FIG. 2, the user rotates the door 200 shown in FIG. 2 to the state shown in FIG. 1 to close the door 200.

During the rotation, the door 200 approaches the cover 300 and the door hanging unit 260 of the door 200 is engaged and locked to the door locking unit 330 so that the door 200 is closed.

At this time, referring to FIG. 11, the pusher stem assembly 2520 is moved along with the door 200 and the cushion 2530 (of the pusher stem assembly 2520) may be brought into contact with the cover 300. The stem 2540 of the pusher stem assembly 2520 is retracted as the door 200 is continually rotated, that is, the user further presses the door 200 and closes toward the cover 300, and the spring 2550 becomes compressed by the backward movement of the stem 2540 so that the door is closed.

In operation, the user presses the door opening button 210 shown in FIG. 1.

Then, the locking state of the door locking unit 330 to the door hanging unit 260 (of the door 200 shown in FIG. 2) is released.

At this time, as the door opening unit 250 is relaxed, and the length of the spring 2550 of the door opening unit 250 is extended.

Further, the cover 300 and the components of the washing machine 10 coupled thereto are fixed to the wall, so that they do not move despite the extension of the spring 2550. Instead, the elastic force of the spring 2550 is transmitted to the cover 300 through the stem 2540 and the cushion 2530. In addition, the elastic repulsive force (e.g., pushing force) corresponding to the elastic force is transmitted to the door 200 through the guide structure 2510, and as a result, the door 200 is reverse-rotated in the open direction.

That is, the guide structure 2510 and the pusher stem assembly 2520, which are the door opening unit 250 of the door 200, are moved along with the door 200, as indicated by an arrow "F", due to the reaction of the elastic force when the spring 2550 is relaxed or stretched and thus the door is opened as shown in FIG. 12.

Figure 13:
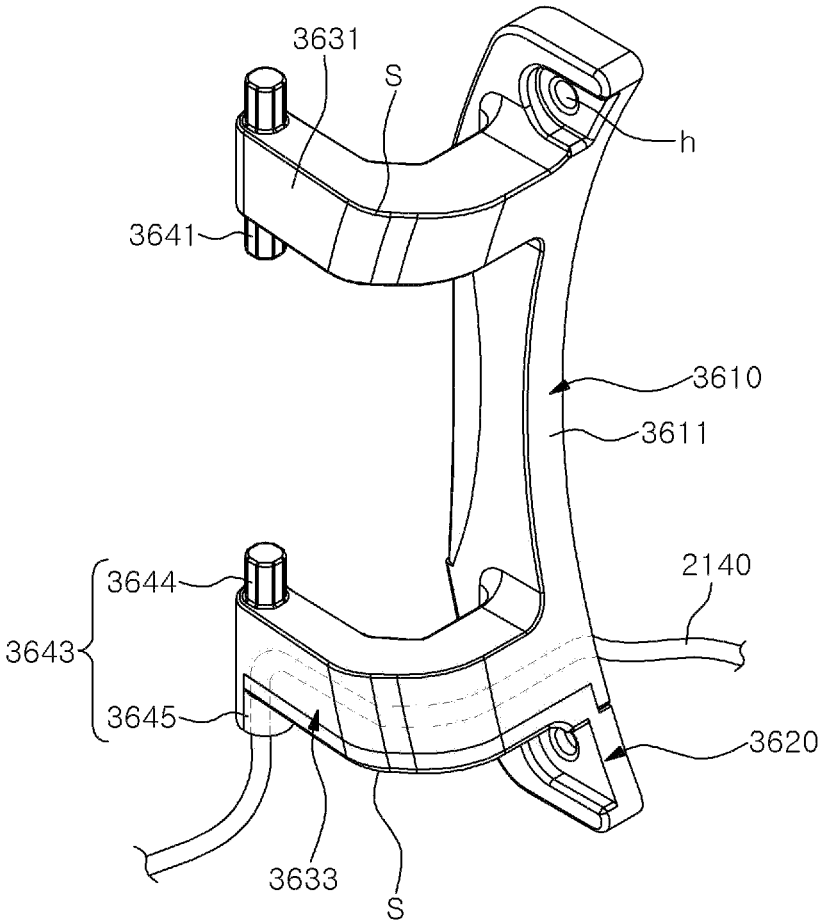
FIG. 13 is a perspective view of the door hinge shown in FIG. 2.
Figure 14:
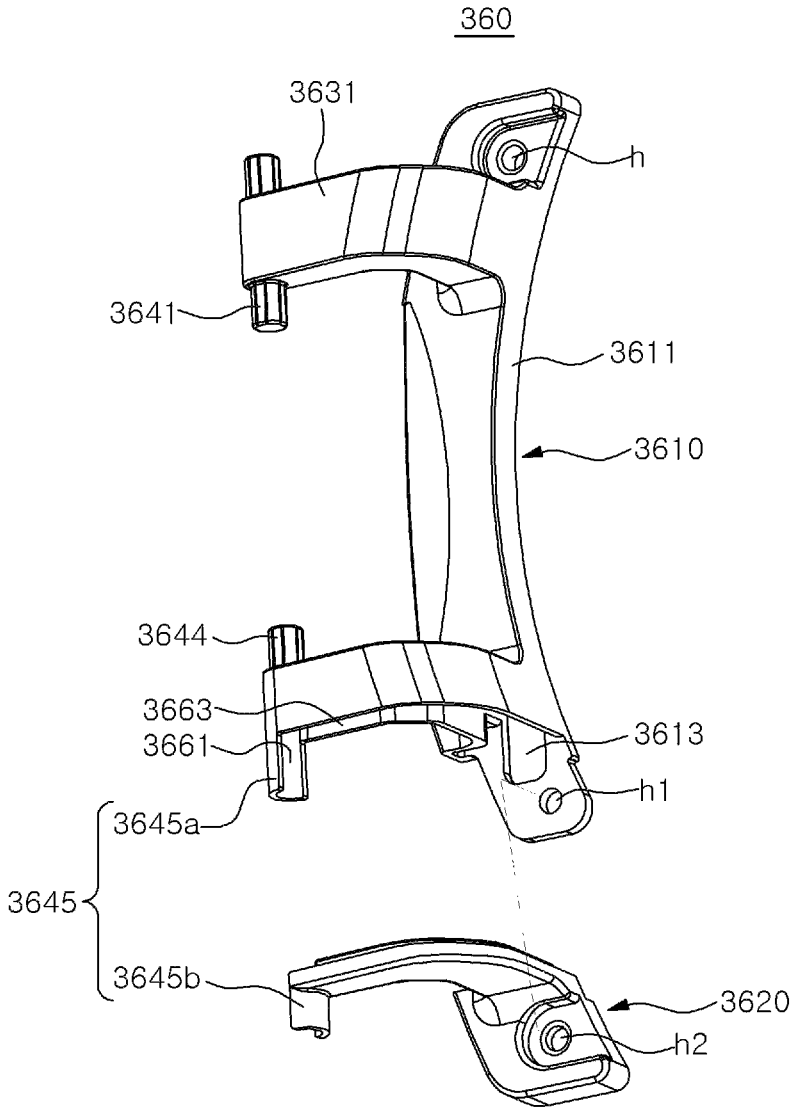
FIG. 14 is a front perspective view for describing the assembly relation of the door hinge shown in FIG. 13.
Figure 15:
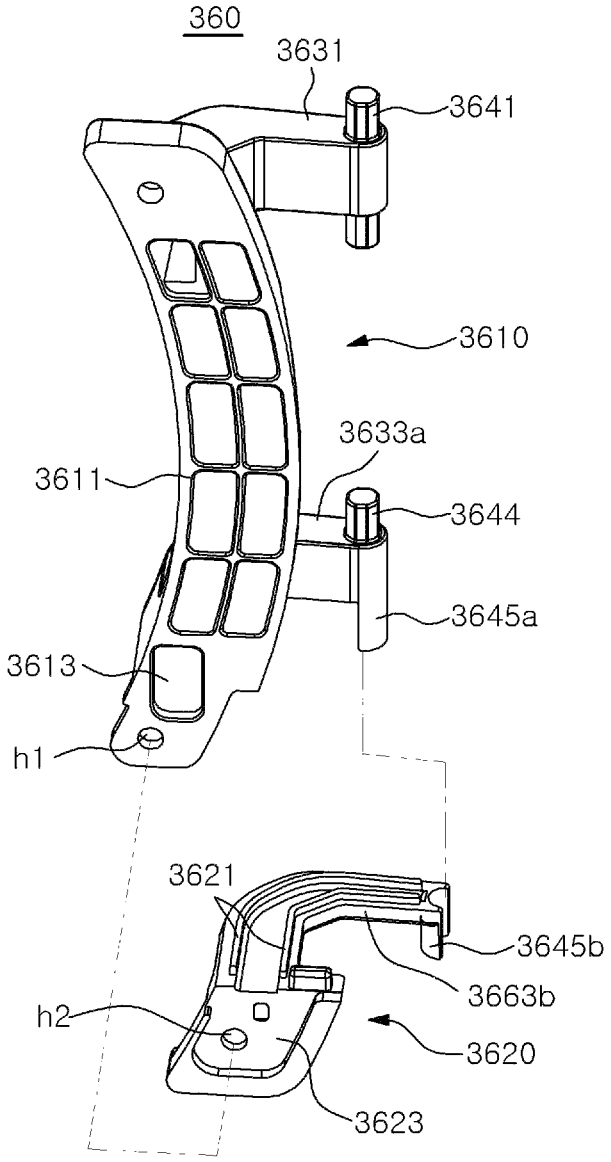
FIG. 15 is a rear perspective view for describing the assembly relation of the door hinge shown in FIG. 13.

FIG. 13 is a perspective view of the door hinge shown in FIG. 2, FIG. 14 is a front perspective view for describing the assembly relation of the door hinge shown in FIG. 13, and FIG. 15 is a rear perspective view for describing the assembly relation of the door hinge shown in FIG. 13.

Referring to FIGS. 13 to 15, the door hinge 360 connects the door 200 to the cover 300 so that the door 200 is rotatably supported based on the cover 300 to open and close the laundry inlet 302. A first hinge arm 3631 and a second hinge arm 3633 of the door hinge 360 may be accommodated in the door hinge connection unit 232 provided at one side of the door outer frame 240 and the door inner frame 230.

The door hinge 360 may be provided by assembling or engaging a door hinge case 3610 constituting the upper portion of the door hinge 360 and a door hinge cap 3620 constituting the lower portion of the door hinge 360.

Specifically, the door hinge 360 includes a bracket 3611 that is secured to the cover 300.

In addition, the door hinge 360 includes the first hinge arm 3631 and the second hinge arm 3633 extending from the bracket 3611 with a curved surface S toward the door 200 side.

In addition, the door hinge 360 includes a first shaft 3641 and a second shaft 3643 which are formed at respective ends of the first hinge arm 3631 and the second hinge arm 3633 and are rotatably coupled to the door hinge connection unit 232 to serve as a rotation center of the door 200.

In addition, the door hinge 360 includes cable guide tunnels 3661 and 3663 formed (or made) by a combination of a door hinge case 3610 and a door hinge cap 3620. The cable guide tunnels 3661 and 3663 may include a cable passing paths inside the door hinge 360.

First, the bracket 3611 is fixed to one side of the cover 300 and may be fastened to the cover 300 by a fastening member such as a bolt (not shown) including one or more fastening holes 'h'.

Specifically, the upper end of the bracket 3611 is integrally formed with the base portion of the first hinge arm 3631, and has a fastening hole h.

The lower end of the bracket 3611 has a relatively thin thickness compared to the upper end of the bracket 3611 and has a first overlapping hole "h1" which may form the same hole depth as the fastening hole h when they are overlapped with each other The door hinge cap 3620 includes a recess portion 3623 that may be overlapped on the lower end of the bracket 3611 when assembled to the door hinge case 3610. The recess portion 3623 is formed in a groove shape capable of receiving the lower end portion of the bracket 3611. In the recess portion 3623, a second overlapping hole "h2" is formed with respect to a position corresponding to the first overlapping hole h1

When the first overlapping hole h1 and the second overlapping hole h2 are overlapped with each other, the above-mentioned fastening hole h may be completed.

A bolt (not shown) for fixing the door hinge 360 to the cover 300 may be fastened to the first overlapping hole h1 and the second overlapping hole h2 overlapping with each other or the fastening hole h.

Herein, one side of the cover 300 to which the bracket 361 is fixed may be the opposite side of the door locking unit 330. Thus, one side of the door 200 is rotatably supported on one side of the cover 300 by a door hinge 360 provided on one side of the cover 300, and the other side of the door 200 is rotatable. Thus, a state where the door hanging unit 260 is coupled to the door locking unit 330, e.g., such as locking, or a state where the door hanging unit 260 is released from the door locking unit 330, e.g., such as unlocking, may be maintained according to the rotation the other side of the door 200.

The first hinge arm 3631 and the second hinge arm 3633 may be integrally formed on the front surface of the bracket 3611 to protrude from the bracket 3611 fixed to the cover 300 toward the door 200 side. The first hinge arm 3631 and the second hinge arm 3633 may be spaced apart from each other. In addition, the first hinge arm 3631 and the second hinge arm 3633 each may be formed to have a curved surface "S" when they protrude from the bracket 3611 toward the door 200 side. The curved surface S may be bent outward of the cover 300 from the laundry inlet 302. By this curved surface S, the angle at which the door 200 is opened from the cover 300 may be increased.

The first shaft 3641 protrudes from the upper surface and the bottom surface of the end portion of the first hinge arm 3631 to face its protrusions and the second shaft 3643 protrudes from the upper surface and the bottom surface of the end portion of the second hinge arm 3633 to face its protrusions.

The first shaft 3641 and the second shaft 3643 may be positioned and rotatably coupled between the door inner frame 230 and the door outer frame 240. Specifically, the first shaft 3541 and the second shaft 3643 may be rotatably disposed in a shaft connection unit (not shown) provided in the door hinge connection unit 232 of the door 200. The first shaft 3641 and the second shaft 3643 located in the shaft connection unit of the door hinge connection unit 232 may support the rotation of the door 200.

However, the second shaft 3643 may be divided into a second shaft upper portion 3644 and a second shaft lower portion 3645. The second shaft upper portion 3644 is integrally formed with the second hinge arm 3633 similar to the first shaft 3641 integrally formed and protruded from the first hinge arm 3631, and the second shaft lower portion 3645 is integrally formed by coupling the door hinge case 3641 3610 and a door hinge cap 3620. The second hinge arm 3633 and the second shaft low portion 3645 are described below.

As such, the door hinge 360 may be an assembly made by joining the door hinge case 3610 and the door hinge cap 3620. In addition, the door hinge 360 may be formed with cable guide tunnels 3661 and 3663 for allowing the cable 2140 to extend or pass by coupling the door hinge case 3610 and the door hinge cap 3620.

The cable 2140 serves to electrically connect the control unit 810 with the opening button circuit module 2110 and the switch circuit board unit 2120. This cable 2140 may extend from the inside of the door 200 into the cabinet 100, e.g., towards the control unit 810 in the cabinet 100.

The cable 2140 may extend or pass through the inner space of the cable guide tunnels 3661 and 3663 and may be protected by being wrapped by the walls of the cable guide tunnels 3661 and 3663. In other words, the cable guide tunnels 3661 and 3663 serve to guide the extension of the cable 2140, to protect the cable 2140, and to prevent twisting of the cable due to a cable passage in the door hinge 360.

Hereinafter, it will be described that the bracket 3611, the first hinge arm 3631 and the first shaft 3641 are formed on the door hinge case 3610 and the second hinge arm 3633 and the second shaft 3643 are formed on the door hinge case 3610 and the door hinge cap 3620.

Specifically, referring to FIG. 14, the cable guide tunnels 3661 and 3663 may be formed on the second hinge arm 3633 and the second shaft 3643 with respect to a portion where the door hinge case 3610 and the door hinge cap 3620 may be coupled to each other.

First, the second hinge arm 3633 may be formed by combining a second hinge arm upper portion 3633*a* formed in the door hinge case 3610 and a second hinge arm lower portion 3633*b* formed in the door hinge cap 3620.

The second hinge arm upper portion 3633*a* has the cable guide tunnels 3661 and 3663 formed on the bottom surface thereof and on the inner side of the first frame 3645*a*.

The cable guide tunnels 3661 and 3663 are completed when the second hinge arm upper portion 3633*a* and the second hinge arm lower portion 3633*b* are assembled together.

The cable guide tunnels 3661 and 3663 may be composed of a vertical cable guide tunnel 3661 formed in the inner side of the first frame 3645*a*, and a horizontal cable guide tunnel 3663 interconnected in a space with respect to the second cable guide tunnel 3661 and formed on the bottom of the second hinge arm upper portion 3633*a*.

The horizontal cable guide tunnel 3663 extends to correspond to an extension of the second hinge arm upper portion 3633*a* and the shape of the curved surface S. In addition, the entrance of the horizontal cable guide tunnel 3663 is space-connected to the cable guide hole 3613 of the bracket 3611.

In addition, the entrance of the vertical cable guide tunnel 3661 is disposed at the bottom of the second shaft lower portion 3645.

These cable guide tunnels 3661 and 3663 form a space through which the cable 2140 may pass.

When the door hinge case 3610 and the door hinge cap 3620 are assembled together, the bottom opening of the cable guide tunnels 3661 and 3663 of the second hinge arm upper portion 3633*a* is shielded by the second hinge arm lower portion 3633*b*.

The second hinge arm lower portion 3633*b* may include guide ribs 3621 to make it easier to assemble the second hinge arm upper portion 3633*a* and the second hinge arm lower portion 3633*b*.

The guide ribs 3621 protrude to have predetermined heights on both sides of the upper surface of the second hinge arm lower portion 3633*b* and extend along the extension of the second hinge arm lower portion 3633*b* and the shape of the curved surface S. In addition, each guide rib 3621 may be arranged at positions that are a predetermined distance from the outer surface of the second hinge arm lower portion 3633*b* to the inner direction of the second hinge arm lower portion 3633*b*.

When the second hinge arm upper portion 3633*a* and the second hinge arm lower portion 3633*b* are assembled together, the guide ribs 3621 of the second hinge arm lower portion 3633*b* are inserted into an opening of the bottom of the horizontal cable guide tunnel 3663. As a result, the outer surface of the second hinge arm upper portion 3633*a* and the outer surface of the second hinge arm lower portion 3633*b* may be at a same level.

The cable 2140 may be inserted into the entrance of the vertical cable guide tunnel 3661 of the second shaft lower portion 3645, and then may get out the outside of the cable guide hole 3613 of the bracket 3611 through the horizontal cable guide tunnel 3663. The second shaft lower portion 3645 includes a first frame 3645*a* formed on the door hinge case 3610 and a second frame 3645*b* formed on the door hinge cap 3620 to form the vertical cable guide tunnel 3661.

Specifically, the second shaft lower portion 3645 may include a first frame 3645*a* and a second frame 3645*b* each formed in a semicircular tube shape similar to the shapes of the circular columns forming the shaft shape to form a single vertical column cable guide tunnel 3661 in the shape of one hollow circular column when the first frame 3645*a* and the second frame 3645*b* are coupled to each other.

For this purpose, the first frame 3645*a* and the second frame 3645*b* have semicircular grooves formed therein which are mutually combinable. Therefore, when the first frame 3645*a* and the second frame 3645*b* are coupled to each other, the semicircular grooves may be formed into a shape that is mutually combinable, and the interior of the combined first frame 3645*a* and the second frame 3645*b* results in the cable guide tunnel 3661. The vertical cable guide tunnel 3661 formed on the second shaft lower portion 3645 may be communicated with the horizontal cable guide tunnel 3663 in the second hinge arm 3633 so that the tunnel may act as a cable passing path in the door hinge 360 and that may prevent breakage or twisting of the cable 2140 when the door 200 is rotated.

In accordance with the present embodiment, the cable 2140 may pass or extend through the inner side of the door hinge 360 safely via the cable guide tunnels 3661 and 3663. Consequently, the cable 2140 may not be exposed outside of the washing machine 10, and the cable 2140 may not be twisted even when the door 200 is rotated.

As described above, in a wall mounted washing machine according to the embodiments of the disclosure, there is an advantage that a separate handle for opening and closing the door may be removed.

In addition, the locking release state of the door locking unit and door opening may be easily performed merely by the operation of a door opening button, thereby maximizing user convenience when door opening and closing.

In addition, there is an advantage in that the door may be easily opened with an electronic opening and closing type.

In addition, there is an advantage in that the door may be opened and closed by a door opening unit which protrudes when the locking state of the door is released.

In addition, there is an advantage in that the door may be opened quickly by utilizing both an elastic force of the door opening unit and an elastic force of a door gasket.

In addition, there is an advantage in that the door may be opened by manually releasing a lock of the door locking unit when power is lost or the control unit fails.

In addition, there is an advantage in that twisting of the cable that electrically connects the PCB substrates (provided in the door) and the control unit (provided in the cabinet) may be prevented.

Moreover, there is an advantage in that the cable may be protected from being exposed to the outside of the washing machine when the cable extends from the inside of the door into the cabinet.

The above description is merely illustrative of the technical idea of the present disclosure and various changes and modifications may be made without departing from the essential characteristics of the present disclosure. Therefore, the embodiments described in the present disclosure are not intended to limit the scope of the present disclosure, but are intended to illustrate and not limit the scope of the present disclosure. The scope of protection of the present disclosure should be construed according to the following claims, and all technical ideas which are equivalent or equivalent thereto should be interpreted as being included in the scope of the present disclosure.

What is claimed is:

1. A wall mounted washing machine comprising:

a cabinet having front and rear surfaces;

a tub disposed in the cabinet to store wash water;

a front panel disposed on the tub;

a drum rotatably installed in the tub;

a cover disposed on the front panel and comprising a door hinge;

a door rotatably coupled to the door hinge and comprising a door glass; and a door opening and closing device of an electronic opening and closing type and adapted for selectively locking or unlocking the door, wherein the door hinge is adapted for rotatably supporting the door based on the cover to selectively open and close a laundry inlet of the cover, and comprising a cable guide tunnel which forms a path in which a cable is operable to extend from an inside of the door into the cabinet, wherein the door hinge comprises: a door hinge case constituting an upper portion of the door hinge; and a door hinge cap constituting a lower portion of the door hinge, and wherein further the door hinge comprises:

a bracket attached to the cover;

a first hinge arm and a second hinge arm extending from the bracket to a door side with a curved surface; and a first shaft and a second shaft formed at respective ends of the first hinge arm and the second hinge arm and rotatably coupled to the door and operable to serve as rotation centers of the door, and wherein further the second shaft comprises a second shaft upper portion and a second shaft lower portion, wherein the second hinge arm comprises a second hinge arm upper portion formed on the door hinge case and a second hinge arm lower portion formed on the door hinge cap, wherein the cable guide tunnel exists in the second hinge arm and the second shaft lower portion based on a portion where the door hinge case and the door hinge cap are coupled, wherein an upper end of the bracket has a fastening hole, and a lower end of the bracket has a thin thickness compared to the upper end of the bracket and has a first overlapping hole, wherein the door hinge cap includes a recess portion that may be overlapped on the lower end of the bracket when assembled to the door hinge case, wherein the recess portion has a second overlapping hole is formed with respected to a position corresponding to the first overlapping hole, and the first overlapping hole and the second overlapping hole are overlapped with each other.

2. The wall mounted washing machine according to claim 1, wherein the second shaft lower portion comprises a first frame in the form of a semicircular tube formed in the door hinge case and a second frame in the form of the semicircular tube formed in the door hinge cap.

3. The wall mounted washing machine according to claim 2, wherein further, the cable guide tunnel comprises:

a vertical cable guide tunnel formed on an inner side of the first frame and the second frame of the second shaft lower portion; and a horizontal cable guide tunnel formed by shielding an opening by the second hinge arm lower portion, the opening being interconnected in a space with respect to the vertical cable guide tunnel and formed on a bottom surface of the second hinge arm upper portion.

4. The wall mounted washing machine according to claim 3, wherein the horizontal cable guide tunnel extends to correspond to an extension of the second hinge arm upper portion and to correspond to the shape of a curved surface, and wherein an entrance of the horizontal cable guide tunnel is coupled to a cable guide hole formed in the bracket.

5. The wall mounted washing machine according to claim 1, wherein the door opening and closing device comprises:

a door hanging unit disposed on the door and protruding toward the cover;

a door locking unit disposed on the cover and coupled to the door hanging unit to lock the door hanging unit; and a door opening unit disposed on the door with respect to a position spaced apart from the door hanging unit and adapted to generate a force required to open the door, and wherein the door locking unit is coupled to a control unit located within the cabinet and wherein further the door locking unit releases the door hanging unit in response to a control event from the control unit.

* * * * *